US007204059B2

(12) United States Patent
Schiffmann et al.

(10) Patent No.: US 7,204,059 B2
(45) Date of Patent: Apr. 17, 2007

(54) DOOR JAMB PROTECTOR

(75) Inventors: Glenn P. Schiffmann, St. Germain, WI (US); David R. Cox, St. Germain, WI (US)

(73) Assignee: Custom Millworking, Inc., Eagle River, WI (US)

( * ) Notice: Subject to any disclaimer, the term of this patent is extended or adjusted under 35 U.S.C. 154(b) by 0 days.

(21) Appl. No.: 10/615,960

(22) Filed: Jul. 8, 2003

(65) Prior Publication Data

US 2004/0006938 A1 Jan. 15, 2004

Related U.S. Application Data

(60) Provisional application No. 60/403,955, filed on Aug. 16, 2002, provisional application No. 60/394,811, filed on Jul. 9, 2002.

(51) Int. Cl.
*E06B 1/04* (2006.01)
*E06B 1/34* (2006.01)
*E04F 19/02* (2006.01)

(52) U.S. Cl. ..... 52/211; 52/212; 52/717.01; 52/98; 52/DIG. 12; 52/741.3; 49/460; 49/462

(58) Field of Classification Search ..... 52/211, 52/212, 717.01, 98, DIG. 12, 741.3; 49/460, 49/462

See application file for complete search history.

(56) References Cited

U.S. PATENT DOCUMENTS

| | | | | | |
|---|---|---|---|---|---|
| 2,837,787 | A | | 6/1958 | Wright | |
| 3,130,455 | A | * | 4/1964 | Borlenghi | 49/504 |
| 3,391,509 | A | | 7/1968 | Fruman | |
| 3,559,356 | A | | 2/1971 | Koral | |
| 3,712,003 | A | | 1/1973 | Hallock et al. | |
| 3,797,185 | A | * | 3/1974 | La Borde | 52/288.1 |
| 3,875,713 | A | * | 4/1975 | Laborde | 52/288.1 |
| 3,918,228 | A | * | 11/1975 | LaBorde | 52/288.1 |
| 3,974,606 | A | | 8/1976 | LaBorde | |
| 4,242,848 | A | | 1/1981 | Schoultz | |
| 4,439,965 | A | * | 4/1984 | Langenhorst | 52/211 |
| 4,443,508 | A | | 4/1984 | Mehl | |
| 4,768,320 | A | | 9/1988 | Weller | |
| 5,058,323 | A | * | 10/1991 | Gerritsen | 49/504 |
| 5,182,880 | A | | 2/1993 | Berge, Jr. et al. | |

(Continued)

FOREIGN PATENT DOCUMENTS

| | | |
|---|---|---|
| DE | 9016865 | 5/1991 |

(Continued)

*Primary Examiner*—Robert Canfield
(74) *Attorney, Agent, or Firm*—Wilhelm Law Service, S.C.; Thomas D. Wilhelm

(57) ABSTRACT

Removable door jamb assembly guard, guarded jamb assembly, and methods of controlling a doorway. The guard preferably covers the full length of the jamb assembly, and the full width of the jamb assembly between an outer trim element and the door-arresting surface. The guard has a central section, a door leg section, an outer leg section disposed outwardly of the central section, and optionally a transition section between the central section and the outer leg section. Preferred embodiments of the guard can be installed on a jamb assembly while a conventional door slab is mounted to the jamb assembly, and the door slab can be closed and opened without the guard interfering with such operation of the door slab.

48 Claims, 13 Drawing Sheets

U.S. PATENT DOCUMENTS

| | | | | | |
|---|---|---|---|---|---|
| 5,203,130 | A | | 4/1993 | Freelove | |
| 5,528,869 | A | * | 6/1996 | Boomer et al. | 52/212 |
| 5,737,878 | A | | 4/1998 | Raulerson et al. | |
| 5,775,045 | A | | 7/1998 | Hill | |
| 5,799,443 | A | | 9/1998 | Koeniguer | |
| 5,815,998 | A | | 10/1998 | Wamsher | |
| 5,836,118 | A | * | 11/1998 | Thornton et al. | 52/204.1 |
| 5,893,243 | A | * | 4/1999 | Ortner | 52/211 |
| 6,125,605 | A | * | 10/2000 | Young | 52/717.01 |
| 6,266,933 | B1 | | 7/2001 | Park | |
| 6,360,500 | B1 | * | 3/2002 | Wilcox | 52/217 |
| 6,604,334 | B2 | * | 8/2003 | Rochman | 52/717.01 |
| 2002/0046532 | A1 | | 4/2002 | Rochman | |
| 2002/0056241 | A1 | * | 5/2002 | Wilcox | 52/217 |

FOREIGN PATENT DOCUMENTS

| | | |
|---|---|---|
| FR | 2714107 | 6/1995 |

* cited by examiner

DOOR JAMB PROTECTOR

This application claims priority under 35 U.S.C. 119(e)(1) to Provisional Application Ser. No. 60/394,811 filed Jul. 9, 2002, and to Provisional Application Ser. No. 60/403,955, filed Aug. 16, 2002, both of which are herein incorporated by reference in their entireties.

BACKGROUND

The present invention relates generally to devices which are designed to protect door jamb assemblies, and objects being moved through openings in which such door jamb assemblies are installed. The invention relates particularly to devices which are temporarily and removably mounted to doorjamb assemblies during periods when the door jamb assemblies are susceptible to elevated risk of damage.

Door jamb assemblies are assembled at manufacturing locations. Such door jamb assemblies require protection during shipping in the ordinary stream of commerce.

Individuals, families, and businesses commonly move from one location to another. Typically, a wide variety of belongings are moved with them. In addition, individuals, families, and businesses purchase items which, at times, can be large and bulky. These items, such as appliances, furniture, office equipment, and the like, are used to aid and assist the purchaser as well as provide for a comfortable and workable environment.

Moving such bulky and/or massive items can be a challenge. Due to the great weight of many such items, in combination with their sometimes awkward size, moving such items through a doorway can entail significant risk that the item being moved through the doorway will impact upon the door jamb assembly. This contact and engagement can cause damage not only to the door jamb assembly, but also to the item being moved through the doorway.

Similarly, during construction of new buildings, or renovation of buildings, exterior door jambs and door trim, namely door jamb assemblies, are typically installed about the door openings early in the construction process, and well before the remainder of the construction process is completed. Further, it is common to install a temporary door slab during the construction process, so the door can be closed and locked to exclude unauthorized entry to the building during the construction period.

In addition to security considerations, such early installation of a door jamb assembly facilitates installation of building materials which interface with, or otherwise cooperate with, the door jamb assembly. Also typically, once the door jamb assembly is installed, other building components are assembled to the building in cooperation with the jamb assembly such that subsequent removal of the jamb assembly for repair or replacement is an especially costly, and therefore undesirable, undertaking.

Where a door slab is installed, and is used during the construction project, it is common to install a temporary door slab of low aesthetic quality, whereby any damage done to the door slab is generally inconsequential. A permanent door slab is then installed in place of the temporary door slab as one of the last items in the construction project. By so withholding installation of the permanent door slab until very close to the end of the construction project, the chances for damaging the permanent door slab, as part of the construction project, are greatly reduced.

Indeed, during the ongoing phase of the construction project, a wide variety of workers, inspectors, owners, and other affected parties enter and leave the premises. During such ingress and egress, such persons move a wide variety of construction materials and equipment, such as table saws, tool boxes, air compressors, air hoses, extension cords, lights, ladders, dry wall, molding, appliances, cabinets, flooring, and the like, through the limited cross-section opening at the doorway. Inevitably, the door jamb elements and/or door trim elements of the finished door jamb assembly are struck, rubbed, abraded, or the like, and thus damaged by the materials and equipment passing through the door opening. In addition to the damage caused to the door jamb assembly, such contact can also cause damage to the items being moved through the doorway.

All the above disturbances to both the door frame, and materials and products potentially damaged by impact with the door frame, typically applies to all the door frames at all the respective doors in the building. Consequently, as the completion of e.g. the construction project, or the moving project, or the bringing in of newly-acquired items, approaches, the damaged door jambs and/or door trim must typically be repaired. In some cases, the repair can be done on site, while the respective jamb assembly remains assembled to the building.

Normally, however, such repair entails removing the damaged door jambs and trim from the rough opening and replacing them with new door jambs and trim. Such repair or replacement, whether on site or off site, must be done by skilled craftsmen. As suggested above, where an exterior doorway is to be repaired, removal of the door jamb assembly can involve removal of selected portions of siding and sheathing around the door opening, which seriously disrupts the smooth flow of completion of the construction project. In addition, even temporarily removing the jamb assembly significantly increases the cost of securing the building against unauthorized entry while the door jamb assembly is removed from the door opening.

In addition to the above, the damage may or may not be susceptible to repair, whereby the damaged door jamb assembly may have to be replaced by a new door jamb assembly.

Even if the jamb assembly can be repaired, such repair entails considerable time and expense, not to mention inconvenience to both the building occupant and the contractor responsible for the construction project. Further, the quality of the repair is commonly less than the quality of the original factory manufactured product.

The longitudinal edges of the door jamb assemblies, including door trim, are thus particularly vulnerable to damage when contacted by materials or equipment. In order to protect such edges, a guard may be placed over the finished door jamb assembly until the construction project, or moving project, or other project which elevates the risk of damage to the door jamb assembly, has been completed.

A substantial variety of guard structures are known for protecting door jamb assemblies. While certain known temporary guard structures have certain beneficial features, certain such structures do not accommodate closure of the door slab while the protective guard structure is installed on the door jamb assembly, thus failing to prevent unauthorized entry.

Other known structures accommodate closure of the door slab while temporarily reducing clearance between the door slab and the guard on the jamb assembly, by imposition of the guard structure into the clearance space normally available to accommodate modest mounting tolerances normally in effect for mounting the door slab in the jamb assembly. Thus, such other structures require the door slab to share the normal clearance space, between the door slab and the jamb assembly, with the thickness of the guard. In such instance, any variation from target clearances about the opening, with respect to the door slab to be installed therein, when the jamb assembly is fabricated, or any tolerance-type variation in the door slab or the jamb assembly, are exaggerated by the reduced magnitude of the nominal clearance between the door slab and the jamb assembly, which increases the potential for difficulty in actually getting the door slab to close on the opening.

One can, of course, specify/design an increase in the clearance between the door slab and the jamb assembly in order to allow for the thickness of the guard structure. However, such increased clearance between the door slab and the jamb assembly remains, as an excessive clearance, when the temporary guard is removed, whereby the user of the building can perceive the door slab as being too loose, not properly fitted to the jamb assembly. Thus, in conventional technology, the promise of a temporary guard wherein the door slab can be closed on the opening with the guard installed, is accompanied by excessively close clearances with the temporary guard installed and/or excessively wide clearances when the temporary guard is removed.

Accordingly, it is an object of the invention to provide a temporary door jamb assembly guard, and a door jamb assembly so guarded, wherein a door-side leg section of the guard extends along the door arresting surface of the jamb assembly.

It is another object of the invention to provide a temporary door jamb assembly guard wherein an outer leg section of the guard, extending from a central section of the guard, has a substantially greater length than a door leg section of the guard.

Yet another object of the invention is to provide a temporary door jamb assembly wherein the outer leg section comprises a resiliently cushioning nose member extending, along an arcuate path, outwardly from an underlying trim element at the outer surface of the door jamb assembly.

A further object is to provide a temporary door jamb assembly guard having a transition section between the central section and the outer section, wherein the transition section preferentially transfers forces exerted thereagainst, e.g. by impact with articles moving through the doorway, away from the door opening and toward the door jamb and/or the brick mold, or equivalent.

A more specific object is to provide such temporary door jamb assembly guard, having transfer webs, or other support structure, receiving such forces from the transfer section and transferring such forces to underlying elements of the door jamb and/or trim element at locations displaced from the transition section.

It is still another object of the invention to provide a method of temporarily protecting a door jamb assembly, including installing, on the jamb assembly, a guard having a door-side leg section which terminates in the vicinity of the door arresting surface of the jamb assembly, without interfering with typical clearance between the door slab and the jamb assembly when the door slab is closed on the doorway opening.

Still another object is to provide a jamb assembly guard, and method of use, the jamb assembly guard having a central section, an outer leg section, and a transition section between the outer leg section and the central section, and further optionally including support structure underlying the transition section, which support structure transfers forces, which are imposed on the transition section, to underlying surfaces of the jamb and/or a trim element.

SUMMARY

In general, the invention comprehends removable door jamb assembly guards, guarded jamb assemblies, and methods of controlling a doorway opening e.g. in a building. The guard generally covers the full length of the jamb assembly, along the left side, right side, and preferably along the top, of the jamb assembly, and the full width of the jamb assembly between an outer trim element, such as a brick mold, and the door-arresting surface of the jamb. The guard has a central section, a door leg section, an outer leg section disposed outwardly of the central section, and optionally a transition section between the central section and the outer leg section. Preferred embodiments of the guard can be installed on a jamb assembly while a conventional door slab is mounted to the jamb assembly, and the door slab can be closed and opened without the guard interfering with such operation of the door. In the alternative, the guard can be installed on the jamb assembly as early as before the jamb assembly is mounted in the doorway of a building, and the door slab subsequently installed on the jamb assembly, either before or after the jamb assembly is mounted in the doorway of the building.

In a first family of embodiments, the invention comprehends a temporary door jamb assembly guard for installation over, and for temporarily protecting, a door jamb assembly, optionally while the door jamb assembly is attached to a wall which defines a door or doorway opening, during a period when such door jamb assembly is susceptible to an elevated level of risk of damage. The door jamb assembly has an inner-facing surface for facing into the door opening, a door-arresting surface, and an outer surface facing away from the door-arresting surface. The inner-facing surface extends from the door-arresting surface to the outer surface. The temporary door jamb assembly guard comprises a central section which overlies the inner-facing surface of the door jamb assembly, the central section having a first door side, and a second opposing side displaced from the door side; a door leg section, connected to the central section at the first door side; and an outer leg section, directly or indirectly connected to the central section at the second side facing away from the door. The door leg section has a first length between the first door side of the central section and an opposing distal edge of the door leg section, the outer leg section having a second length, substantially greater than the first length, between the second side of the central section and an opposing distal edge of the outer leg section.

In preferred embodiments, the guard can be installed on a doorjamb assembly, and a conventional door slab, mounted to the door jamb assembly, can be operated normally, namely closed and opened, with the guard so installed, without interfering with operation of the door slab.

Also in preferred embodiments, the guard is designed and configured to fit over, and protect, an outer trim element which is part of the door jamb assembly.

In some embodiments, the outer leg section comprises an interface member connected to the central section at the second side which faces away from the door. The interface member is sized and configured to extend at a transverse angle to the central section. The interface member is arranged and configured such that the interface member can extend over, and overlie, at least a portion of the outer surface of the door jamb assembly, the outer leg section further comprising a resiliently cushioning nose member extending outwardly in front of the interface member. A cavity is optionally defined between the interface member and the resiliently cushioning nose member.

In some embodiments, the door jamb assembly guard covers less than the entirety of a width of the inner-facing surface of the door jamb assembly for which the guard has been designed and configured.

In some embodiments, the guard further comprises a break-away cover tab, extending from a distal end of the outer leg section, and adapted to extend over an outer face of a trim element of the jamb assembly, with a line of weakness at the distal end of the outer leg section.

In other embodiments, the guard comprises a break-away cover tab, extending from a distal end of the outer leg section, and adapted to extend over an outer face of a trim element of the jamb assembly, with a line of weakness at a locus overlying an outer surface of the trim element adjacent, but displaced from, the distal end of the outer leg section.

In some embodiments, the outer leg section extends in an arcuate outer surface to an under-curled cushioning distal end.

In some embodiments, the outer leg section comprises a separate cover tab element adapted to cover an outer face of a trim element of the door jamb assembly.

In some embodiments, the guard comprises a first outer leg member, and a second outer leg member attached to the first outer leg member at a locus displaced from a distal edge of the first outer leg member.

In preferred embodiments, the door leg section is designed and configured to fit, on a correspondingly configured door jamb assembly, between the door-arresting surface and a weather strip element mounted proximate the door arresting surface.

In some embodiments, the central section comprises inner and outer section elements, for adjusting said jamb assembly guard according to thickness of a jamb assembly between the door-arresting surface and the outer surface. The inner and outer central section elements interlock with each other to establish an adjusted width of the central section corresponding to the thickness of the jamb assembly. The outer leg section is disposed relatively inwardly of the door opening and interfaces with the door-arresting surface. The inner and outer sections are slidingly engageable with each other to cause the inner and outer sections to grippingly engage the door-arresting surface and the outer surface of the jamb assembly, thus to custom adjust width of the central section of the guard to fit the thickness of the respective jamb assembly.

In the alternative, the central section can comprise a line of weakness extending along the length of the central section, wherein the line of weakness facilitates separating the guard into inner and outer sections, as by tearing or breaking at the line of weakness, overlapping the pieces with respect to each other to fit the thickness of the jamb assembly, then securing the inner and outer pieces of the central section to each other to maintain the fitted thickness.

In some embodiments, the guard comprises a transition section between the central section and the outer leg section.

In some embodiments, the central section comprises a release ridge, extending along a length thereof, which release ridge is displaced from an underlying jamb by a distance greater than a base distance by which a remainder of the central section is displaced from the jamb.

In a second family of embodiments, the invention comprehends the door leg section being connected to the central section at the first door side and being sized and configured to extend at a transverse angle to the central section along the door-arresting surface, and the outer leg section being sized and configured to extend at a transverse angle to the central section.

In a third family of embodiments, the guard comprises a transition section between the central section and the outer leg section. The transition section comprises an overlying contact structure directly interfacing with objects which impact on the transition element, and underlying support structure adapted and configured to interface with underlying surfaces of the jamb assembly. The transition section extends between an outer corner of the jamb and an outer corner of any trim element which is part of the jamb assembly, for example and without limitation, at an outer surface of the building at the doorway, and is effective to absorb and distribute forces imposed thereon so as to attenuate damage to the jamb assembly.

In some embodiments, the door leg section terminates at a distal edge thereof which comprises a distal edge of the guard, and which is consistent with termination of the guard in the vicinity of, and protecting, the door arresting surface.

In some embodiments, the guard further comprises a flex joint in the outer leg section, operative for rotating a distal edge of the outer leg section away from an underlying element door jamb assembly.

In some embodiments, the contact structure comprises a contact structure, such as a contact web, extending between first and second sides thereof at the outer leg section and the central section, the underlying support structure comprising at least one transfer web, extending from one of the first and second sides of the contact structure in a direction along at least one of (i) a surface of a trim element or (ii) an outer surface of the jamb.

In some embodiments, the contact structure comprises a contact web, and the underlying support structure comprises a transfer web extending from the contact web along an outer surface of the door jamb assembly to a locus proximate an intersection of the outer face of a trim element and an adjoining surface of the trim element.

In some embodiments, the support structure of the transition section is adapted and configured to reside in a cavity defined between the contact structure, an inner facing surface of the trim element, and an outer surface of the jamb, and to transfer forces from the contact structure to underlying surfaces of the trim element and the jamb at locations away from outer corners of the trim element and the jamb.

In some embodiments the underlying support structure comprises transfer webs connected to the contact structure and to each other to define a cavity between the transfer webs and the contact structure, and further comprising support webs extending between the contact structure and at least one of the transfer webs.

In a fourth family of embodiments, the invention comprehends a temporary door jamb assembly guard for installation over, and for temporarily protecting, a door jamb assembly, optionally while the door jamb assembly is attached to a wall and which defines a door or doorway opening, during a period when the door jamb assembly is susceptible to an elevated level of risk of damage. The door jamb assembly has an inner-facing surface for facing into the door opening, a door-arresting surface, and an outer surface facing away from the door-arresting surface. The inner-facing surface extends from the door-arresting surface to the outer surface. The temporary door jamb assembly guard comprises a central section which overlies the inner-facing surface of the door jamb assembly, the central section having a first door side, and a second opposing side facing away from the door side; a door leg section, connected to the central section at the first door side and sized and configured to extend at a transverse angle to the central section along the door-arresting surface of the door jamb assembly; and an outer leg section directly or indirectly connected to the central section at the second side facing away from the door, the outer leg section comprising an interface member sized and configured to extend at a transverse angle to the central section, the interface member being arranged and configured such that said interface member can be disposed against the outer surface of the door jamb assembly and can extend over, and overlie, at least a portion of the outer surface of the door jamb assembly, the outer leg section further comprising a resiliently cushioning nose member extending outwardly in front of the interface member, a cavity being optionally defined between the interface member and the resiliently cushioning nose member.

In some embodiments, the nose member defines an arcuate cross-section, thereby to transfer substantially all low-to-medium intensity forces, imposed on the nose member, to the interface member proximate the central section and proximate a distal edge of the interface member.

In preferred embodiments, the guard can be installed on a doorjamb assembly, and a conventional door mounted to the door jamb assembly can be closed with the guard so installed, without interfering with operation of the door.

In some embodiments, the guard is designed and configured to fit over and protect at least part of an outer trim element as part of the door jamb assembly.

In some embodiments, the door leg section has a first length between the central section and an opposing distal edge of the door leg section, the outer leg having a second length, substantially greater than the first length, between the second side of the central section and an opposing distal edge of the outer leg section.

In a fifth family of embodiments, the invention comprehends, in combination, a door jamb assembly, and a removable guard mounted over and overlying at least a portion of the door jamb assembly. The combination comprises the door jamb assembly having an inner-facing surface for facing into a door opening, a door-arresting surface, and an outer surface for facing away from the door-arresting surface, the inner-facing surface extending from the door-arresting surface to the outer surface; the removable guard protecting the door jamb assembly from incidental damage. The guard comprises a central section overlying the inner-facing surface of the door jamb assembly, the central section having a first door side, and a second opposing side displaced from the door side, a door leg section, connected to the central section at the first door side, and an outer leg section, directly or indirectly connected to the central section at the second side, displaced from the door opening, the outer leg section extending at a transverse angle to the central section, the outer leg section being disposed against, and protecting, the outer surface of the door jamb assembly.

In preferred embodiments, the guard overlies and protects a brick mold, a mull post, or other trim element, as part of the door jamb assembly.

In preferred embodiments, the combination includes weather stripping adjacent the door-arresting surface, and the door leg section is disposed between the door-arresting surface and the weather stripping, without interfering with routine mounting, or routine operation, of the weather stripping.

In a sixth family of embodiments, the invention comprehends a method of protecting a doorjamb assembly which may be mounted in a doorway and controlling access to a building through the doorway opening, thus protecting the jamb assembly from incidental damage during a period when the door jamb assembly is susceptible to an elevated level of risk of damage. The door jamb assembly comprises left and right upstanding jamb assembly elements, and optionally an upper jamb assembly element extending between the left and right upstanding jamb assembly elements. Each such jamb assembly element has an inner-facing surface facing into such doorway opening, a door-arresting surface, and an outer surface facing away from the door-arresting surface, the inner facing surface extending from the door-arresting surface to the outer surface. The method comprises installing, on one or more of the jamb assembly elements, a removable jamb assembly guard, the jamb assembly guard comprising a central section which overlies the inner-facing surface of the door jamb assembly, and which has a first door side, and a second opposing side displaced from the door side, a door leg section, connected to the central section at the first door side and extending at a transverse angle to the central section along the door-arresting surface of the door jamb assembly, and an outer leg section, connected directly or indirectly to the central section at the second side displaced from the doorway opening, the outer leg section extending at a transverse angle to the central section. The outer leg section of the guard is thus disposed against the outer surface of the door jamb assembly such that the outer leg section extends over, and overlies, at least a portion of the outer surface of the door jamb assembly. The jamb assembly guard, when installed on the door jamb assembly, has the central section thereof overlying the inner-facing surface of the door jamb assembly, the outer leg section overlying and protecting at least a portion of the outer surface of the door jamb assembly, and the door leg section extending across and protecting the door-arresting surface.

In preferred embodiments, the guard is mounted and held to the jamb assembly by friction and/or temporary tab interaction with the jamb assembly.

In some embodiments, the method includes installing the guard on the jamb assembly in combination with a door slab being installed on the jamb assembly, and including closing the door slab, thus to close the door opening, with the guard so installed and without interference between operation of the door slab and the guard.

In some embodiments, the jamb assembly includes an outer trim element disposed outwardly from the door opening, the method including installing the guard so as to protect at least part of an outwardly-facing surface of the outer trim element.

In some embodiments, the central section comprises inner and outer section elements, for interlocking with each other thereby to establish an adjusted width of the central section, the method comprising placing the guard over the jamb assembly with the central section in surface-to-surface contact with the inner-facing surface of the jamb assembly, the outer leg section being disposed relatively outwardly of the doorway opening, the door leg section being disposed at the door-arresting surface, the method further comprising urging the inner and outer sections toward each other, thus slidingly engaging the inner and outer sections with each other and causing the inner and outer sections to grippingly engage the door-arresting surface of the jamb assembly and the outer surface of the jamb assembly, thus to custom adjust the guard to the respective jamb assembly.

In some embodiments, the central section can comprise a line of weakness extending along the length of the central section, wherein the line of weakness facilitates separating the guard into inner and outer separate sections, as by tearing or breaking at the line of weakness. The method of installing the guard includes tearing or breaking the guard at the line of weakness, then overlapping the separated inner and outer guard pieces with respect to each other at the central section, to fit the thickness of the jamb assembly, then securing the inner and outer pieces to each other, at the central section, to maintain the fitted thickness. The overlapped pieces can be secured to each other as by applying tape at the so-defined overlapped joint. In the alternative, one or more pieces of tape can be supplied on the central section, with a release sheet. When the central section is broken, the release sheet is removed, whereby the tape is exposed for securing the pieces to each other when the inner and outer sections are brought together in overlapping relationship.

In preferred embodiments, the method includes removing the guard from the jamb assembly when the period of elevated risk has ended.

Figure 1:
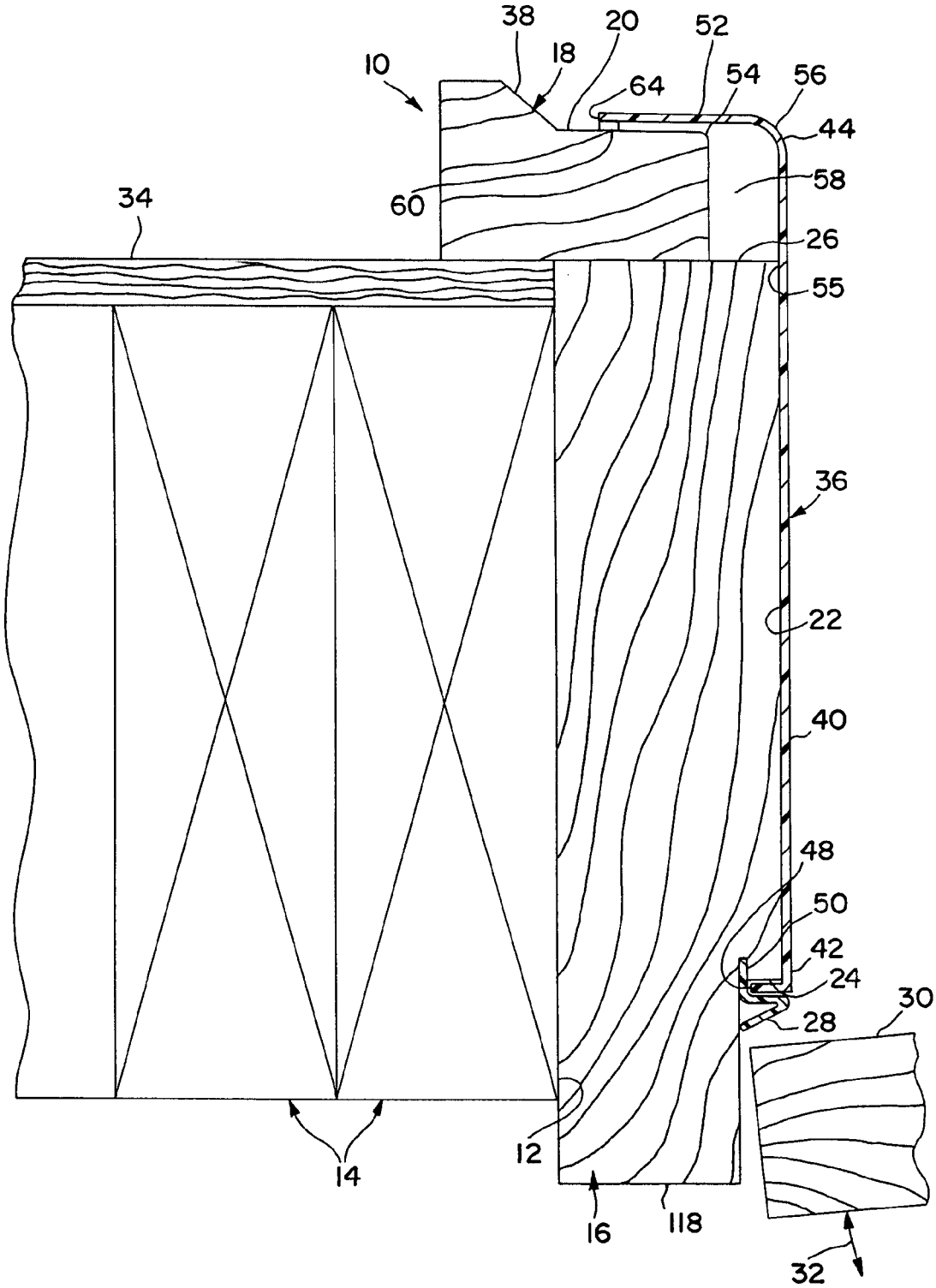
FIG. 1 shows an enlarged representative cross-section of a door jamb assembly guard of the invention, along with a cross-section of a door frame, including door jamb assembly, into which the door jamb assembly guard is installed.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 4:
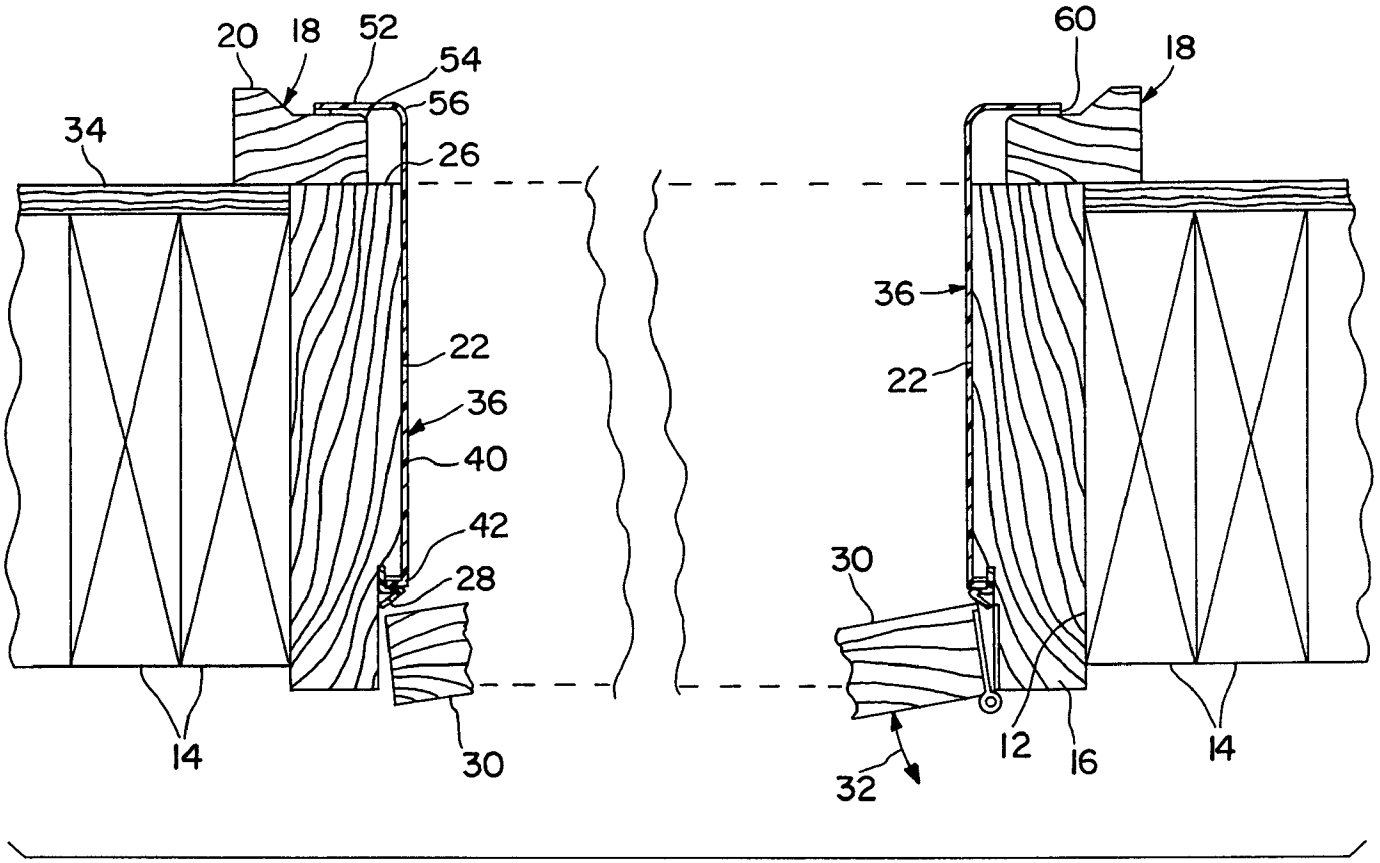
FIG. 4 shows a cross-section as in FIG. 1, reduced in size and showing both sides of the doorway in cross-section, with part of the door opening cut away.

In the embodiments disclosed herein, door jamb assemblies are shown oriented such that the door, also referred to herein as a "door slab," opens inwardly into the building or room or suite being serviced by the door. The principles of the invention apply equally where the door opens in an outwardly direction, with allowance for additional necessary clearance factors. FIG. 1 shows a cross-section of one side of the door jamb assembly 10 mounted in place in the rough opening 12, through which entry is to be controlled by the door. Thus, the studs 14 represented by the illustrated double stud framing in FIG. 1 represent one side of the rough opening, in the building framing, into which the door jamb assembly is installed. Both sides of the opening 12, and thus both sets of double studs 14, are shown in FIG. 4. The door jamb assembly, itself, is illustrated as a jamb 16, and includes a trim element 18, also referred to herein as brick mold 18, mounted on an outer facing surface of jamb 16 e.g. by mechanical fasteners such as screws or nails (not shown), thus to form an outer facing surface 20 of the jamb assembly. Where a side light is used adjacent a doorway in a building, the corresponding trim element is typically referred to as a mull post.

Figure 12:
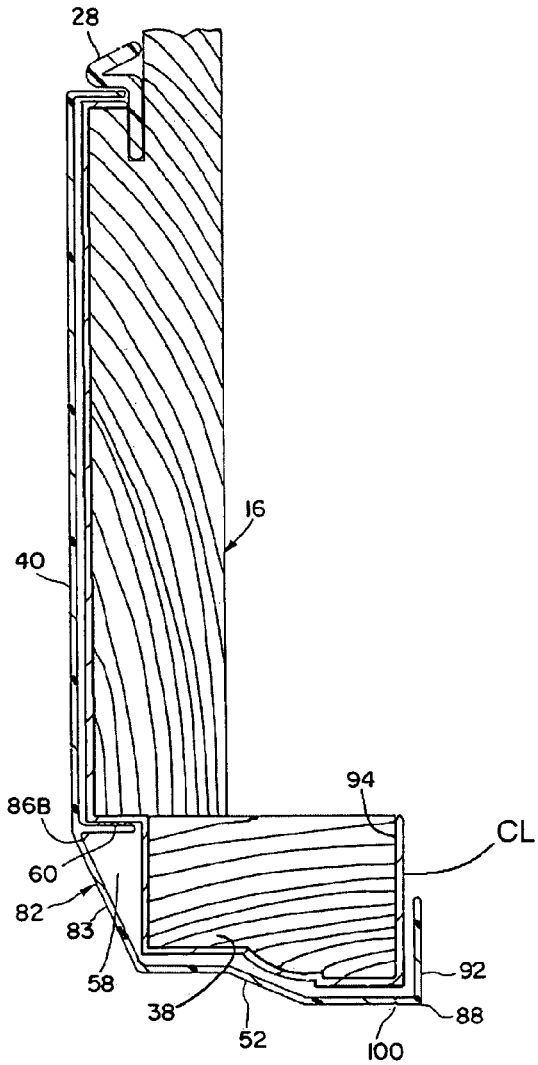
FIG. 12 shows the guard embodiment of FIG. 10, mounted on a cladded jamb assembly.

Jamb 16 can be made of a variety of materials. A typical such material is wood. Another commonly used jamb structure employs wood as a substrate, cladded with, for example, cladding "CL"(FIG. 12), e.g. aluminum or vinyl cladding. In the alternative, jamb structures can be e.g. other than wood such as, for example and without limitation, aluminum or vinyl. The invention herein applies to all conventionally known combinations of jamb materials, and all conventionally known jamb profiles.

A typical jamb assembly 10 includes the jamb 16 which has an inner-facing central surface 22, a door-arresting surface 24 (FIGS. 1, 2 and 5), and an outer surface 26 facing away from the door-arresting surface. The inner-facing central surface 22 generally extends from door-arresting surface 24 to outer surface 26. In addition, the jamb assembly further includes the trim element 18 which is shown mounted on the outer surface 26 of the jamb, thus to form the outer-facing surface 20 of the jamb assembly.

A weather strip or weather seal 28 is shown in FIG. 1 at the door-arresting surface 24 where a door slab 30 swings against and away from the seal 28 in opening and closing the door as indicated by the double headed arrow 32. Whatever material is to be used on the outwardly disposed surfaces of studs 14 to close in the space between the studs and the brick mold is indicated as a layer 34. Layer 34 can be a single layer of e.g. siding, or can include one or more additional layers such as one or more layers of insulation board, sheathing, or the like. Typically, a layer 34 of sheathing is used to close in the space between the studs and the brick mold. Trim element 18 overlies the sheathing as illustrated in FIGS. 1 and 4. Siding, brick, or other exterior material then typically overlies the sheathing and butts up against trim element 18.

As illustrated in FIG. 1, the invention comprehends a guard generally designated as 36, which is specifically designed and configured to fit over the inner-facing surface 22 of jamb 16, and to reach to, and to cover at least a portion of, an outer surface 38 of trim element 18 which defines the outer-facing surface 20 of jamb assembly 10. The guard has a central section 40 which extends from a first door side 42 adjacent weather strip 28 outwardly along the inner-facing surface 22 of the jamb, which surface faces the doorway, and outwardly to a second opposing trim side 44 facing away from the door side of the jamb.

Figure 2:
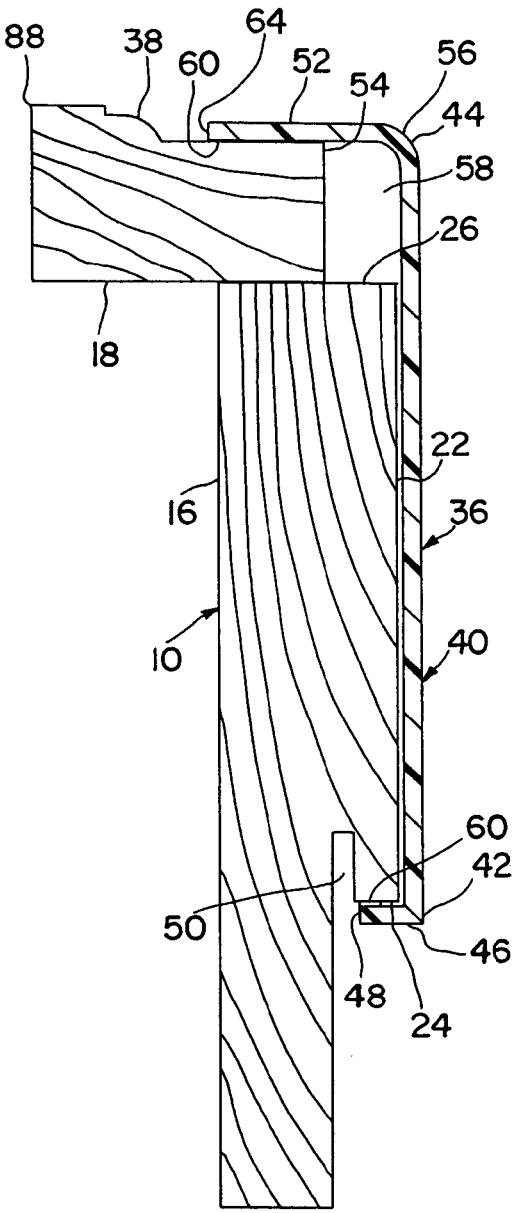
FIG. 2 shows a representative cross-section of a door jamb assembly guard as in FIG. 1, in simplified form.

Door leg section 46 of guard 36, as enumerated in FIG. 2, is connected to central section 40 of the guard at door side 42 and extends generally transverse, e.g. perpendicular, to the central section, along door-arresting surface 24 of the jamb, and terminates at a distal edge 48 of the leg section in the vicinity of the door arresting surface. In the embodiment illustrated in FIGS. 1 and 4, distal edge 48 is located under weather strip 28, at the entrance to notch 50 which receives and holds weather strip 28. Thus, weather strip 28 overlies distal edge 48 of the guard, whereby the distal inner edge 48 of the guard is not exposed for interaction with either the door slab or any material, tools, supplies, or other items traversing the doorway.

An outer leg section 52 of guard 36 is connected to central section 40 of the guard at opposing trim side 44 of the central section, and extends transverse, e.g. perpendicular, to the central section, over a portion of trim element 18, thereby to protect outer corner 54 of the trim element.

It is well known that the most vulnerable, the most commonly damaged elements of the jamb assembly, are outer corner 54 of the trim element, and corresponding outer corner 55 of the jamb.

Outer corner 56 of the guard illustrated in FIG. 1, functions as a shock absorber, and defines a cavity 58 between the guard, the trim element, and the jamb, thus to provide a buffer zone, or shock absorber zone, for dissipating to both the trim element and the jamb any blows or other collisions which land at corner 56. Preferably, guard 36 provides substantial resilient resistance to such forces at outer corner 56, thus to effectively distribute and transfer such forces about the area of guard 36, rather than transferring the forces locally to the jamb and trim element through facile collapse of the guard at cavity 58, especially at outer corners 54 and 55. Such resilient resistance can be provided e.g. by bending resistance of the guard material employed at outer corner 56, or by transferring dispersed elements of the force to underlying portions of the trim element and/or the door jamb, through intervening support structure.

Still referring to guard 36, friction tabs 60 are mounted on both door leg section 46 and outer leg section 52. A friction tab 60 can be configured as a strip of material extending, either continuously or intermittently, along the length of the respective section of the guard.

Tabs 60 can be applied by a variety of methods. For example, tabs 60 can be adhesively mounted, e.g. contact adhesive, to the guard. Preferably, tabs 60 are melt-applied to the guard, such as, for example and without limitation, using hot melt adhesive, coextrusion, or extrusion coating. Friction tabs 60 can be employed elsewhere on the guard, as desired.

Tabs 60 can be for example and without limitation, adhesive tape using a substrate having a relatively high friction surface. As suitable such materials, there can be mentioned e.g. various rubbers and other polymeric materials, such as polyolefins, vinyl acetates, vinyl chlorides, and the like, including suitable additives such as plasticizers and/or tackifiers.

Figure 9:
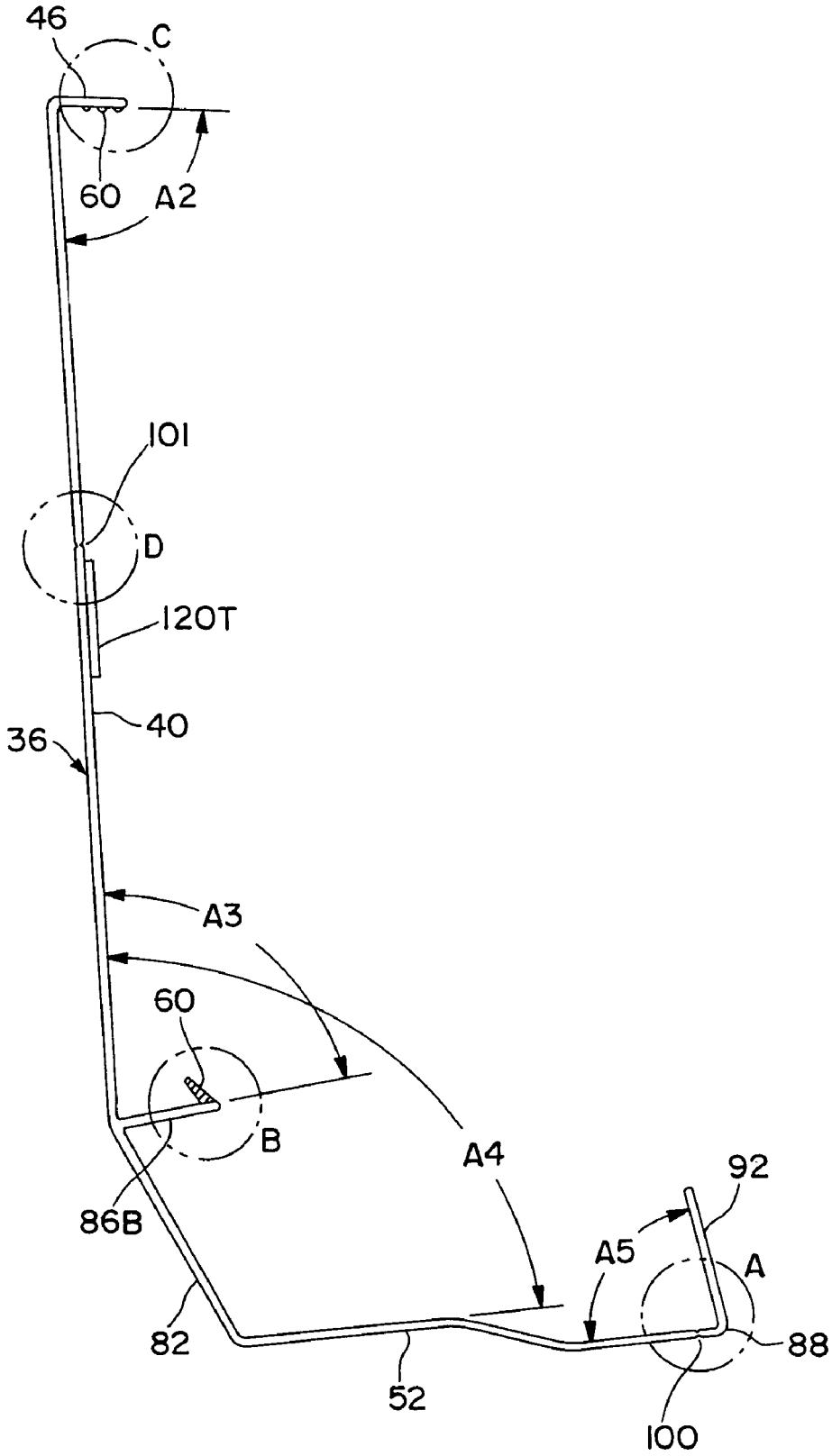
FIG. 9 shows yet another embodiment in cross-section view, prior to mounting the guard on the door jamb assembly.

The surface of tab 60 which interfaces with e.g. jamb 16 or brick mold 18 can have a wide variety of configurations. Thus, the surface can be substantially solid, namely unbroken, as shown in the drawings, or can be more of a textured surface. Exemplary textures include, without limitation, male or female dimples, parallel or non-parallel ridges including random ridges, teeth, or the like, or one or more fingers as illustrated in FIG. 9.

A tab 60 can comprise a relatively less flexible or less compressible substrate disposed toward leg section 46, and a relatively more flexible or more compressible action layer, having such dimples, ridges, or teeth, in interactive contact with e.g. jamb 16 or brick mold 18.

FIG. 2 illustrates the door jamb assembly 10 separate from the building structure, such as during shipping of the jamb assembly to a job site, with guard 36 in place, thus to clearly illustrate the relationships between jamb assembly 10 and guard 36.

Figure 3:
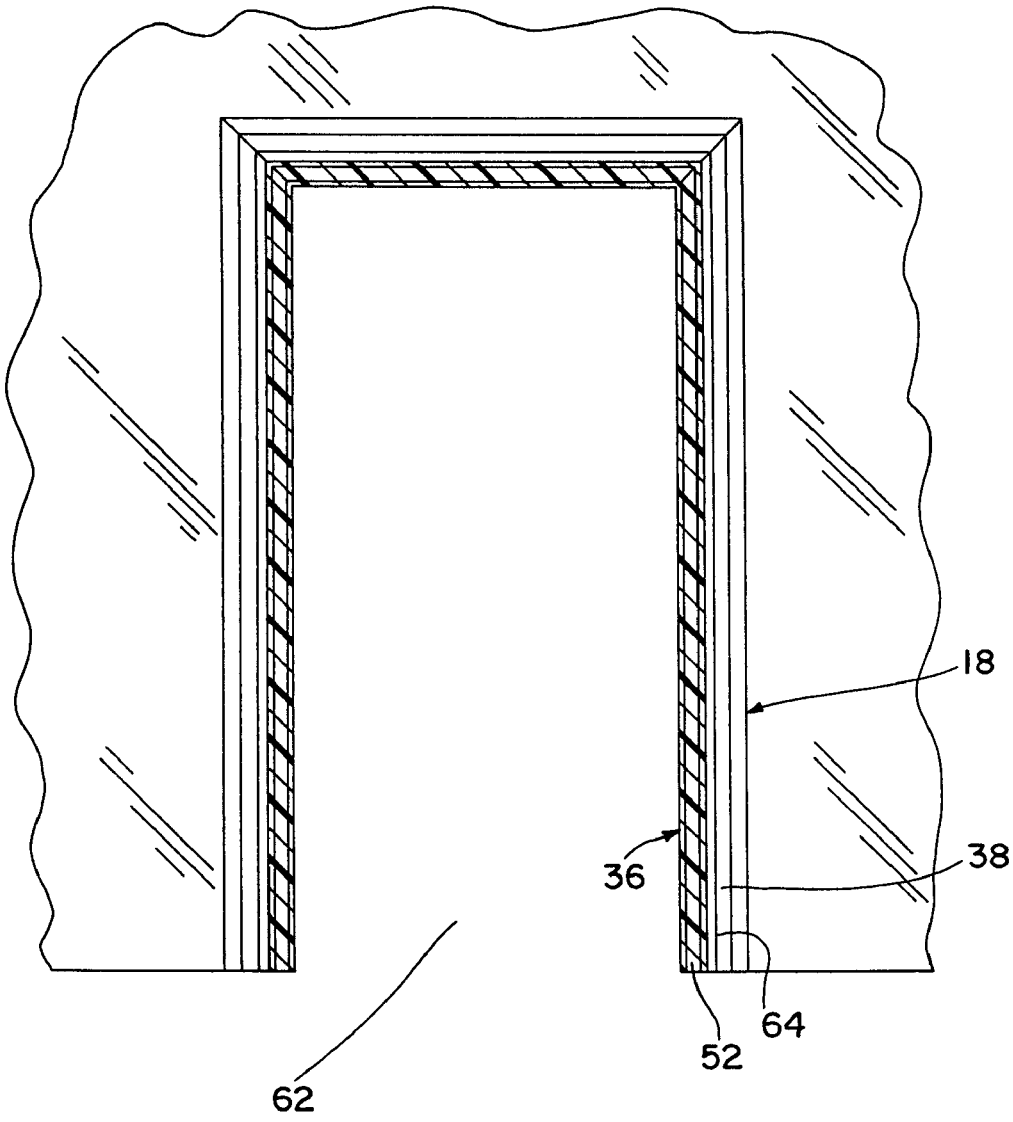
FIGS. 3 and 3A show front elevations of doorways, implementing temporary door jamb assembly guard elements of the invention.

FIG. 3 shows a front elevation of a doorway 62 as defined by the jamb assembly, with the guard of FIGS. 1 and 2 over the jamb assembly. In FIG. 3, guard 36 is cross-hatched in order to distinguish the reach, namely the distal edge 64 of outer leg section 52 of the guard from the outer surface 38 of trim element 18. No door slab is shown in FIG. 3 in order to highlight the jamb assembly and guard.

Figure 3A:
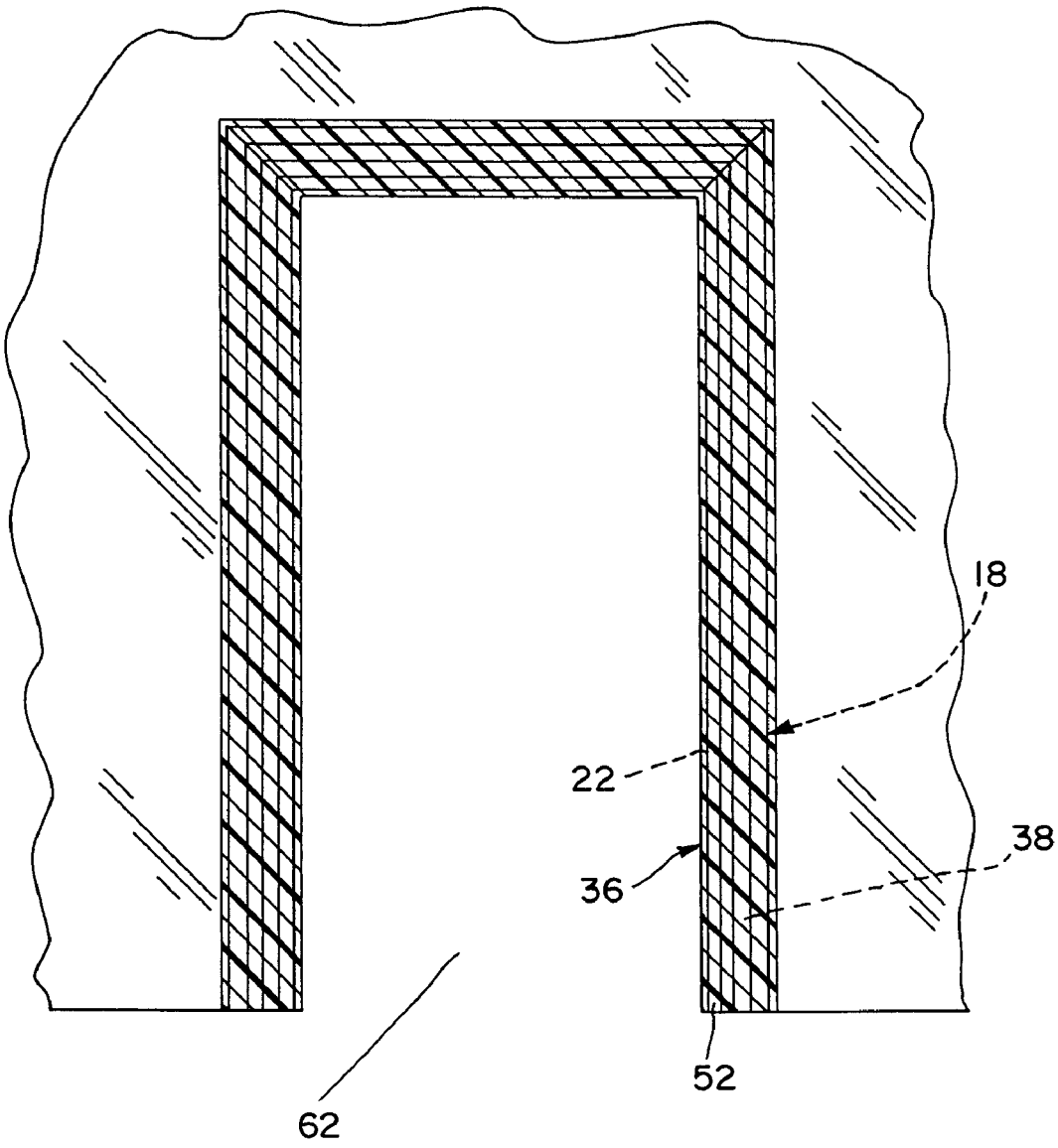

FIG. 3A shows a front elevation as in FIG. 3, but with the guard of FIG. 9, described hereinafter, over the jamb assembly. In FIG. 3A, guard 36 is cross-hatched in order to distinguish the reach, namely the distal end 88, of outer leg section 52 of the guard from the outer surface 38 of the trim element.

Guard 36 is typically installed as 3 elements, namely a left upstanding element, a right upstanding element, and a top element extending between the left and right upstanding elements and covering the top element of the jamb. Accordingly, the three elements of the guard cover substantially the entire external profile or surface of jamb 16, and especially that portion of the jamb profile between the door-arresting surface, and the outer surface of the jamb assembly at outer surface 38 of trim element 18. The three elements can, as desired, be hinged to each other with e.g. plastic hinges whereby guard 36 can be a unitary article.

FIG. 4 shows both sides of the doorway, with guard elements 36 installed on both the left and right sides of the doorway, and with the middle of the doorway cut away to make room to show both left and right sides, as well as to show representatively left and right segments of the door slab 30. The disconnect between the left and right sides of the door shows the operating relationships of the left and right sides of the door slab with the respective guard elements 36.

Figure 5:
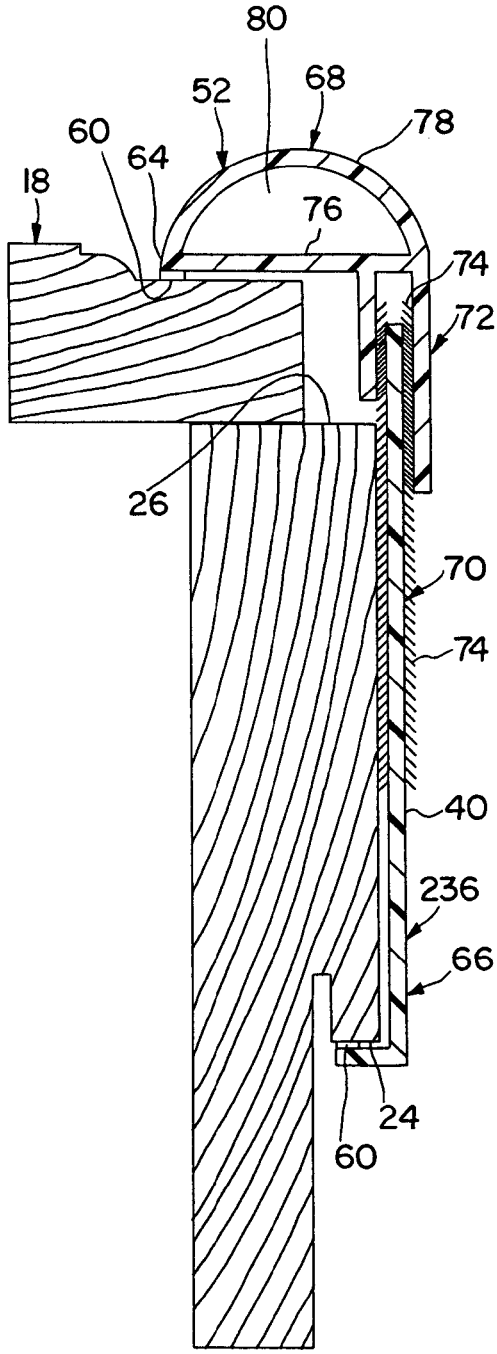
FIG. 5 shows a representative cross-section as in FIG. 2, of a second embodiment of a door jamb assembly guard of the invention, having a nose element extending outwardly from an interface member which lies adjacent a front face of the brick mold.

FIG. 5 shows a second embodiment of guards of the invention, indicated at 236. The guard 236 of FIG. 5 includes a base element 66 and a nose element 68. Base element 66 has an inner male mating section 70. Nose element 68 has an outer female mating section 72. Male mating section 70 is received into female mating section 72, thus to join the base element to the nose element. Mating sections 70 and 72 include retaining fins 74 which interact with each other as male mating section 70 is inserted into female mating section, thus to prevent reverse-direction withdrawal of the base element from the nose element after mating has been effected as illustrated in FIG. 5. The base and nose sections can be separated by removing the guard from the jamb assembly and sliding the base and nose elements with respect to each other along the respective lengths thereof.

Figure 6:
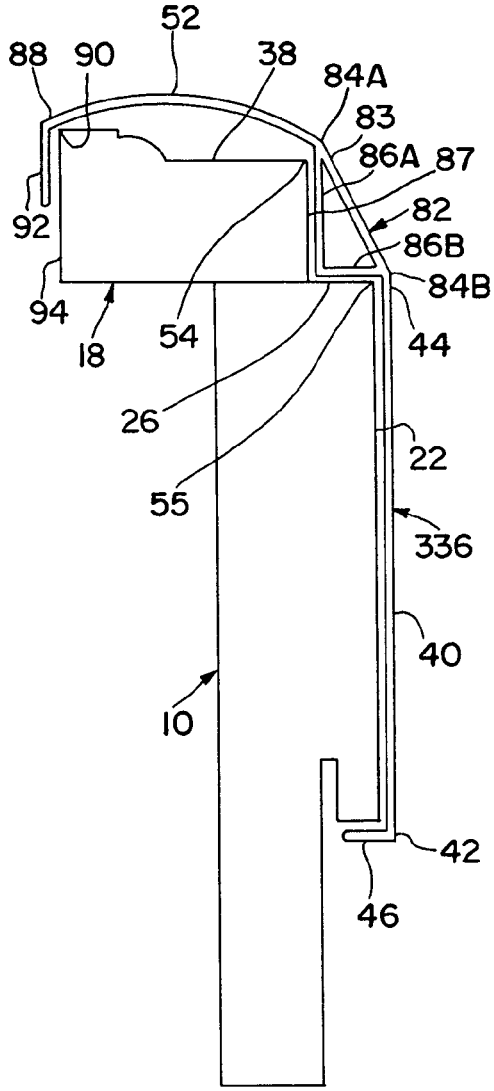
FIG. 6 shows a representative cross-section as in FIG. 2, of a third embodiment of a door jamb assembly guard of the invention, wherein a transition section, including underlying support structure, extends between the central section and an arcuate outer leg section, and wherein a break-away tab extends from the outer leg section over a surface of the brick mold facing away from the doorway.

Outer leg section 52 of nose element 68 includes an interface member 76 which interfaces with trim element 18, and a cushioning nose member 78 which extends outwardly in front of the interface member, and in front of the trim element. A cavity 80 is defined between interface member 76 and nose member 78. Especially nose member 78 is resiliently deflectable, while having substantial bending resistance to forces imposed thereon, thus to transfer substantially all low-to-medium intensity loads such as impacts, imposed on the nose member, to the interface member proximate central section 40 of the guard and proximate distal edge 64 of interface member 76, thus away from outer corner 54 (FIG. 6). To the extent more forceful loads are imposed on nose member 78, the nose member deflects into cavity 80 and can, when enough force is applied, reach interface member 76, whereupon the interface member provides additional e.g. cushioning support. However, for typical mild collisions which impact the nose section, the arcuate cross-section of the nose section is sufficiently resistant to bending that the nose section absorbs the force without relying on the underlying support of interface member 76.

FIG. 6 shows a third embodiment of guards of the invention indicated at 336. Guard 336 includes a central section 40, a door leg section 46, an outer leg section 52, a door side 42 of the central section, and an opposing trim side 44 of the central section.

Further comparing FIG. 6 to FIG. 2, in FIG. 6, a transition section 82 is disposed between the opposing trim side 44 of the central section of the guard, and outer leg section 52. Transition section 82 includes an outwardly disposed contact structure, namely contact web 83 having first and second sides 84A, 84B. Transfer webs 86A, 86B extend, as interface members interfacing with jamb 16 and trim element 18,from sides 84A, 84B of web 83 along, and generally parallel to, the surface 87 of the brick mold and outer surface 26 of the jamb, which underlie transition section 82. As illustrated, transfer webs 86A, 86B are generally in contact with, or in close proximity with, the respective underlying surfaces of the brick mold and the jamb.

Still referring to FIG. 6, outer leg section 52 extends from first side 84A of the transition section to an outer distal end thereof 88 overlying that corner 90 of the brick mold which is most remote from the opening defined inside jamb assembly 10 at the door opening. As seen in FIG. 6, outer leg section 52 therein defines a convex arc, similar to but less pronounced than the arc at nose section 78 of FIG. 5. As in FIG. 5, the convex arc of leg section 52 in FIG. 6 extends outwardly from outer surface 38 of the brick mold. An outwardly-facing cover tab 92 extends from distal end 88 of outer leg section 52 downwardly over that outer face 94 of the brick mold which faces away from the opening and away from inner facing surface 22 of the jamb. Cover tab 92, in combination with outer leg section 52 and transition section 82, cover the entirety of that portion of the brick mold which faces outwardly from the building, as well as the surface 87 of the brick mold which faces generally toward the door opening defined by the jamb assembly.

Yet further referring to FIG. 6 the arc at outer leg section 52 provides for transfer of modest-intensity forces, imposed centrally on the outer leg section, to the brick mold proximate corner 88, and to the transfer web at side 84A of the transfer section, thus to provide enhanced protection for the outer surface of brick mold 18.

Another feature of the arcuate nature of outer leg 52 is that, when a modest force is applied to the arcuate leg section, directed toward the brick mold, inward movement of the outer leg section automatically rotates cover tab 92 away from outer face 94 of the brick mold. Such flexing of the outer leg section can thus be employed to facilitate mounting the guard to the jamb assembly, and corresponding dismounting of the guard when the guard is desirably removed from the jamb assembly.

As suggested by the structure of FIG. 6, the tendency of the outer leg section is to first transfer a force received thereat to the underlying brick mold at corner 88 and to transfer web 86A as well as to transition section 82. As the intensity of the force grows, the tendency of the outer leg section is to deflect downwardly into direct interfacial relationship with outer surface 38 of the brick mold.

In general, as depicted in FIG. 6, web 83 is preferably flat, e.g. planar, between sides 84A, 84B, and along the length of guard 36. Web 83 extends generally across the space between corners 54 and 55, and is spaced from the interior corner which is defined by outer surface 26 of jamb assembly 10 and surface 87 of brick mold 18. In keeping with the generally planar configuration of web 83 between transfer webs 86A, 86B, an inwardly-directed force applied to the transition section, and directly or at an angle toward surface 26 or 87, draws the two ends 84A, 84B of the transition section toward each other, and concurrently drives the joined more distal end portions of transfer webs 86A, 86B into surface-to-surface contact with surfaces 26, 87 of the jamb and brick mold, whereby any tendency of the force to move toward vulnerable corners 54, 55 is attenuated as sides 84A, 848 are at least initially drawn away from corners 54, 55. The above assumes that the force is within the magnitude of forces for which guard 336 has been designed.

Figure 7:
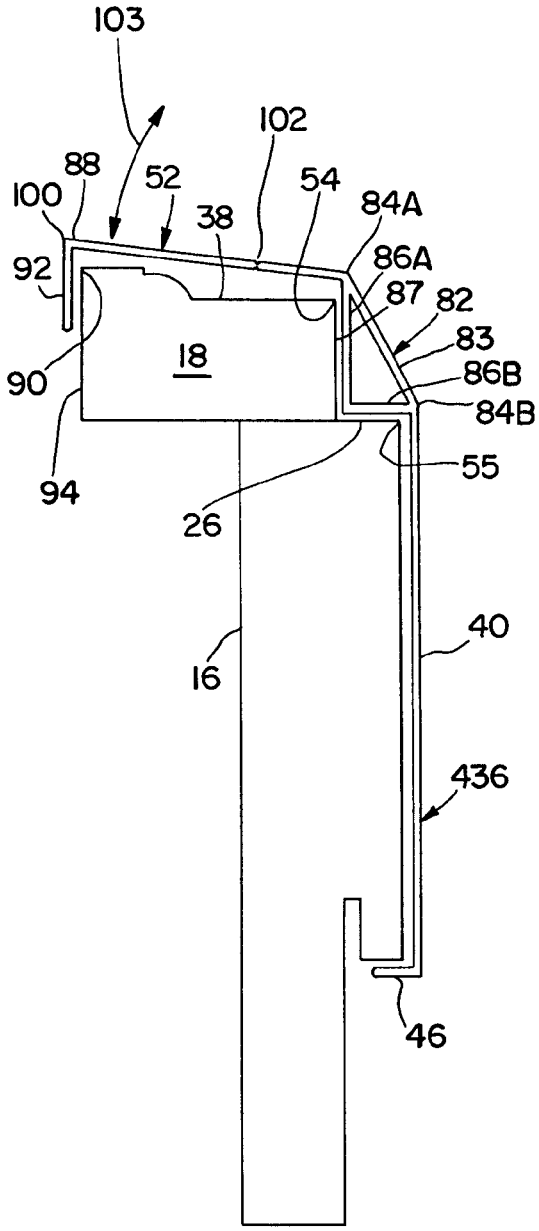
FIG. 7 shows a cross-section as in FIG. 6 having a flex joint extending along the length of the outer section, and wherein the outer section is substantially planar.

FIG. 7 shows a fourth embodiment of guards of the invention, indicated at 436. The guard of FIG. 7 is similar to guard 336 of FIG. 6 in that guard 436 includes, as an interface member, a transition section 82 and transfer webs 86A, 86B. Guard 436 is further similar to guard 336 in that the outer leg section 52 covers the entirety of outer surface 38 of the brick mold. Guard 436 further includes a cover tab 92.

Guard 436 differs from guard 336 in that guard 446 includes a breakable line of weakness 100 at the intersection of distal end 88 of outer leg section 52 with tab 92. Given the full coverage of the outer surface of brick mold 18 by outer leg section 52, supplemented by tab 92, the guard, as initially installed over the jamb assembly protects the entirety of the brick mold outer face 38 from external forces exerted against the jamb assembly. However, as desired for facilitating ongoing progress in completing the construction project in the vicinity of the door, tab 92 can be broken off by the construction workers. For example, where the outer surface of the building extends outwardly from brick mold 18, tab 92 interferes with installation of such outwardly-extending material. Thus, where an outer surface of e.g. brick or stone is used outwardly of e.g. sheathing 34, the brick or stone typically extends outwardly past the brick mold. Accordingly, by structuring guard 436 with breakable line of weakness 100, tab 92 can be removed thus to facilitate installation of the brick or stone, without interfering with continued use of guard 436 to protect the remaining portions of the jamb assembly.

Guard 436 further includes a flex joint 102 in outer leg section 52. Flex joint 102 enables the outer leg section to flex at a predictable location under low load force, thus to facilitate installation of the guard. Joint 102 is also used to move tab 92 out of the way to facilitate installation of thinner section siding materials such as lap siding. Typical such sidings are, without limitation, vinyl siding, aluminum siding, or steel siding. Thus, when it is time to install the siding, the outer leg section is flexed at joint 102, rotating that portion of the outer leg section, distal from the joint, away from the brick mold as suggested by arrow 103. The angle of rotation about joint 102 is as desired by the workers doing the work, and can be any angle which can disable any effective hindrance imposed by outer leg section 52 or tab 92. Tab 92 also moves with the rotating portion of the outer leg section. The tab, and the distal portion of the outer leg section, are held so rotated until such time as installation of the siding has been completed in the vicinity of the door opening. Once siding installation proximate the door opening, and other related work, has been completed, the outer leg section portion, and tab 92, are rotated back into facing relationship with brick mold 18 generally in accord with the orientation shown in FIG. 7, with the outer leg section generally facing outer surface 38, and with tab 92 facing outer face 94 of the brick mold.

Figure 8A:
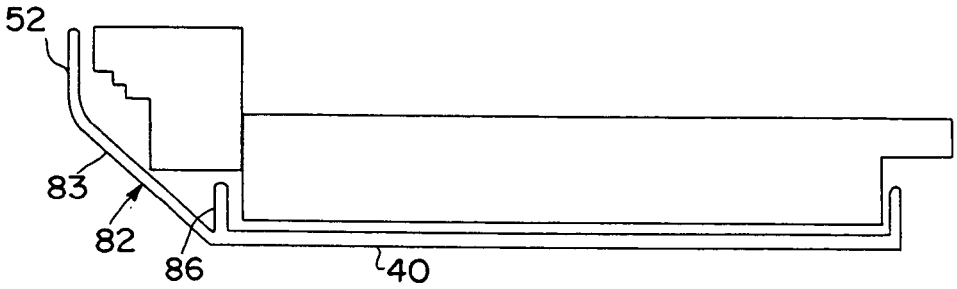
FIGS. 8A–8J illustrate yet further cross-section views of embodiments illustrating temporary door jamb guard assemblies of the invention.

FIGS. 8A–8J illustrate other implementations of jamb assembly guards 36 of the invention. Thus, FIG. 8A shows a planar web 83 at transition section 82, an outer leg section 52 which covers the entire outer surface 38 of the brick mold, and, as an interface member, a single transfer web 86.

Figure 8B:
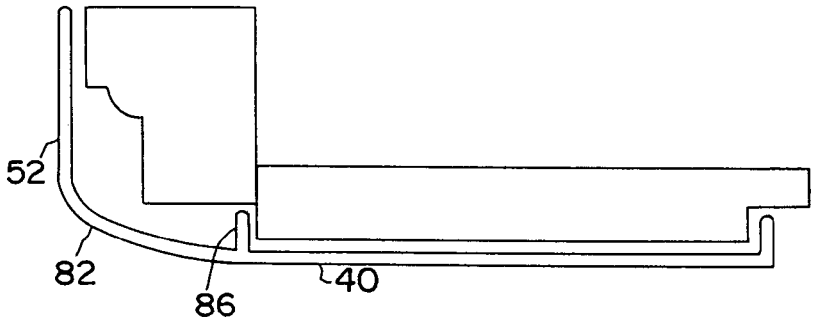

FIG. 8B shows an outer leg section 52 which covers the entire outer surface of the brick mold, a convexly arcuate transfer section 82 between the central section and the outer leg section, and, as an interface member, a single transfer web 86.

Figure 8C:
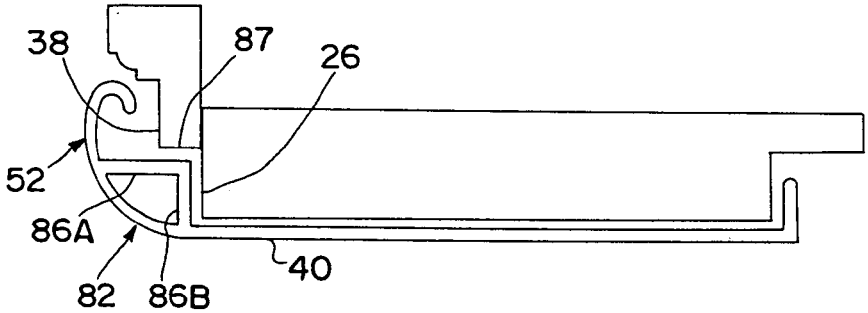

FIG. 8C shows a progressively curving outer leg section 52 which extends from a transition section having an arcuate outer surface and extends to an under-curled distal end of the outer leg section against outer surface 38 of the brick mold. FIG. 8C further employs, as interface members, transfer webs 86A, 86B to transfer external forces from the outer leg section and transition section to surfaces 26 and 87 of the jamb and trim element.

Figure 8D:
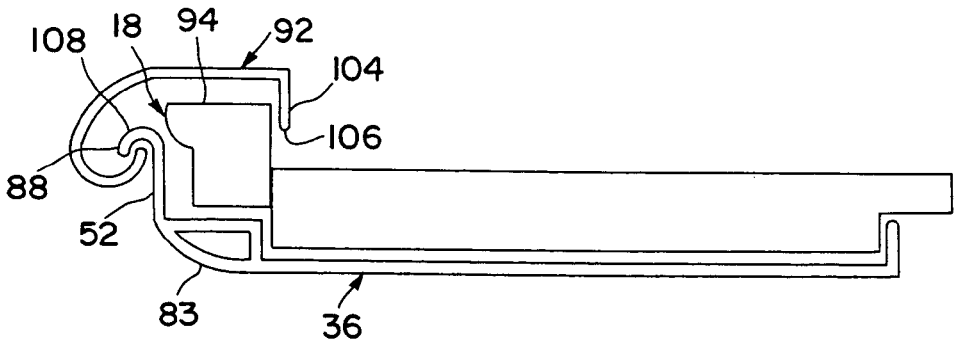

FIG. 8D shows a 2-piece guard wherein a main guard element employs an arcuate outer leg section 52 similar to that of FIG. 8C, but with a reverse curl which progresses outwardly toward distal end 88 of the outer leg section. A separate and supporting arcuate cover tab element 92 covers the entire outer face 94 of the brick mold. A base leg 104 of tab element 92 extends under tab 92 inwardly of outer face 94 to a first edge 106. Tab element 92 extends upwardly from edge 106, along outer face 94, up over outer surface 38 of brick mold 18, and interconnects and interfaces with outer leg section 52, at the reverse curl of the leg section, at a second opposing edge 108 of the tab element, thus to assist in mounting the combination of the main guard element and the tab element to the jamb assembly.

Figure 8E:
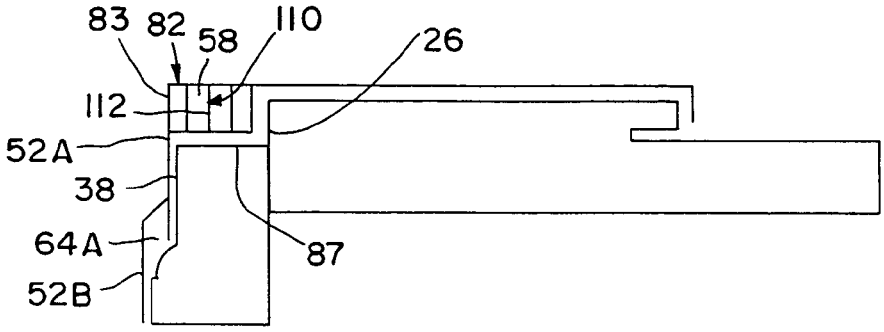

FIG. 8E illustrates a guard wherein transition section 82 has a right-angled outer surface web 83 which is supported by underlying support structure 110 spanning cavity 58 between web 83 and surfaces 26, 87, thus to transfer external forces to surfaces 26 and 87 of the jamb and brick mold. Support structure 110 provides support webs 112 which generally extend across cavity 58. FIG. 8E further illustrates a stepped profile of outer leg section 52 which generally follows the outline of outer face 38 of brick mold 18, including a second outer leg member 52B attached to and extending from a first outer leg member 52A at a locus displaced from the distal edge 64A of the first leg member 52A, and overlying the first outer leg member 52A between the locus of attachment and the distal edge 64A.

Figure 8F:
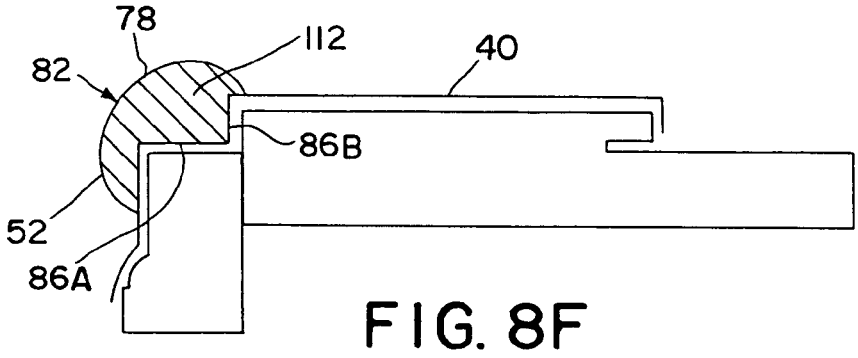

FIG. 8F illustrates a guard wherein guard 36 transitions from central section 40 to outer leg section 52 through a transition section having an arcuate nose member 78, as web 83, defining an arc directed generally at an angle inwardly toward the door opening and outwardly of the building. Web 83 is underlain by, as interface members, transfer webs 86A, 86B. Support webs 112 extend from the nose member to the underlying transfer webs.

Figure 8G:
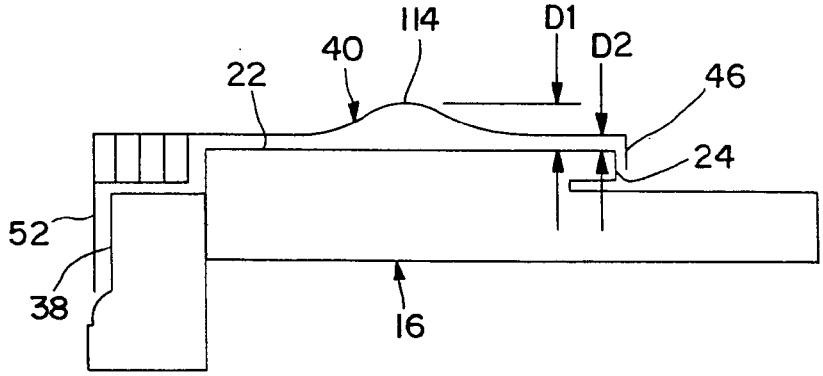

FIG. 8G shows a guard similar to that of FIG. 8E, with two differences. First, outer leg section 52 extends only partially over outer face 38 of the brick mold. Second, central section 40 is configured with an arcuate release ridge 114 which is displaced from the underlying jamb by a distance "D1" which is greater than a base distance "D2" by which the remainder of the central section is displaced from the underlying inner facing surface 22 of jamb 16. Pressing inwardly on release ridge 114 facilitates release of door leg section 46 from door-arresting surface 24, for removal of the temporary installation of the guard from the jamb assembly.

Figure 8H:
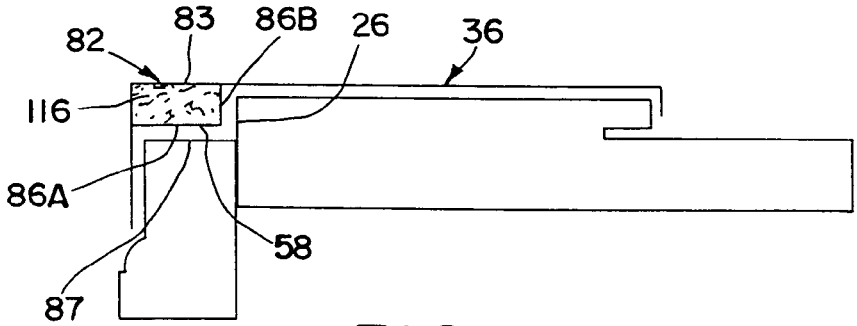

FIG. 8H shows a guard 36 having a sharp-angled web 83 in transition section 82 and, as interface members, underlying transfer webs 86A, 86B. A cushioning filler material 116 is disposed in cavity 58, between web 83 and transfer webs 86A, 868. Filler material 116 can be any material which adds substantially to the impact absorption capacity of the guard as applied where transfer webs 86 interface with surfaces 26 and 87. Preferably, cavity 58 is generally filled with the filler material, thus to provide incremental cushioning affect to the jamb assembly. Suitable filler materials are, for example and without limitation, various of the known cushioning polymer foam products, such as polyurethane foam, polyethylene foam, polystyrene foam, polypropylene foam, and the like. There can also be mentioned pulp molded inserts, paperboard inserts, corrugated paperboard inserts, wood product inserts, and the like. While the filler material need not necessarily fill the entirety of cavity 58, filling of the cavity is preferred.

Figure 8I:
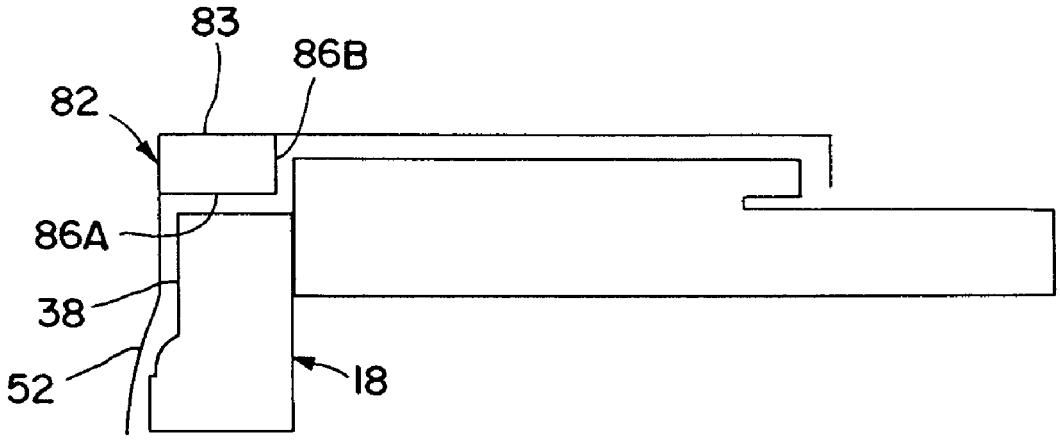

FIG. 8I shows a guard 36 having a sharp-angled, e.g. 90 degrees, web 83 leading to a contoured outer leg section 52 which generally follows the contour of outer face 38 of the brick mold. Web 83 is supported by, as interface members, transfer webs 86A, 86B which intersect web 83 at loci displaced from the sharp-angled corner defining the conversion from a direction following generally the central section to a direction following generally along the outer face of the brick mold.

Figure 8J:
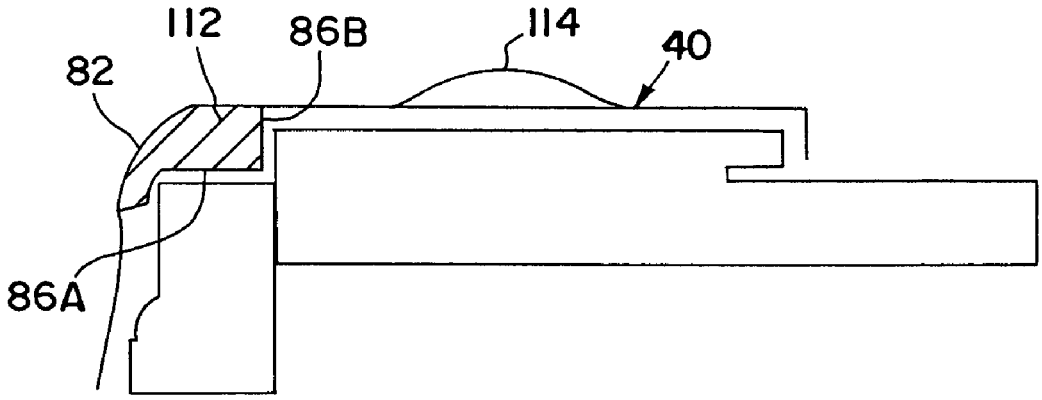

FIG. 8J shows a guard 36 having a large-radius arc at web 83, underlain by, as interface members, transfer webs 86A, 86B, and by connecting support webs 112. FIG. 8J further shows a release ridge 114, as a separate layer of material secured to, but centrally spaced from, central section 40 of the guard.

Figure 10:
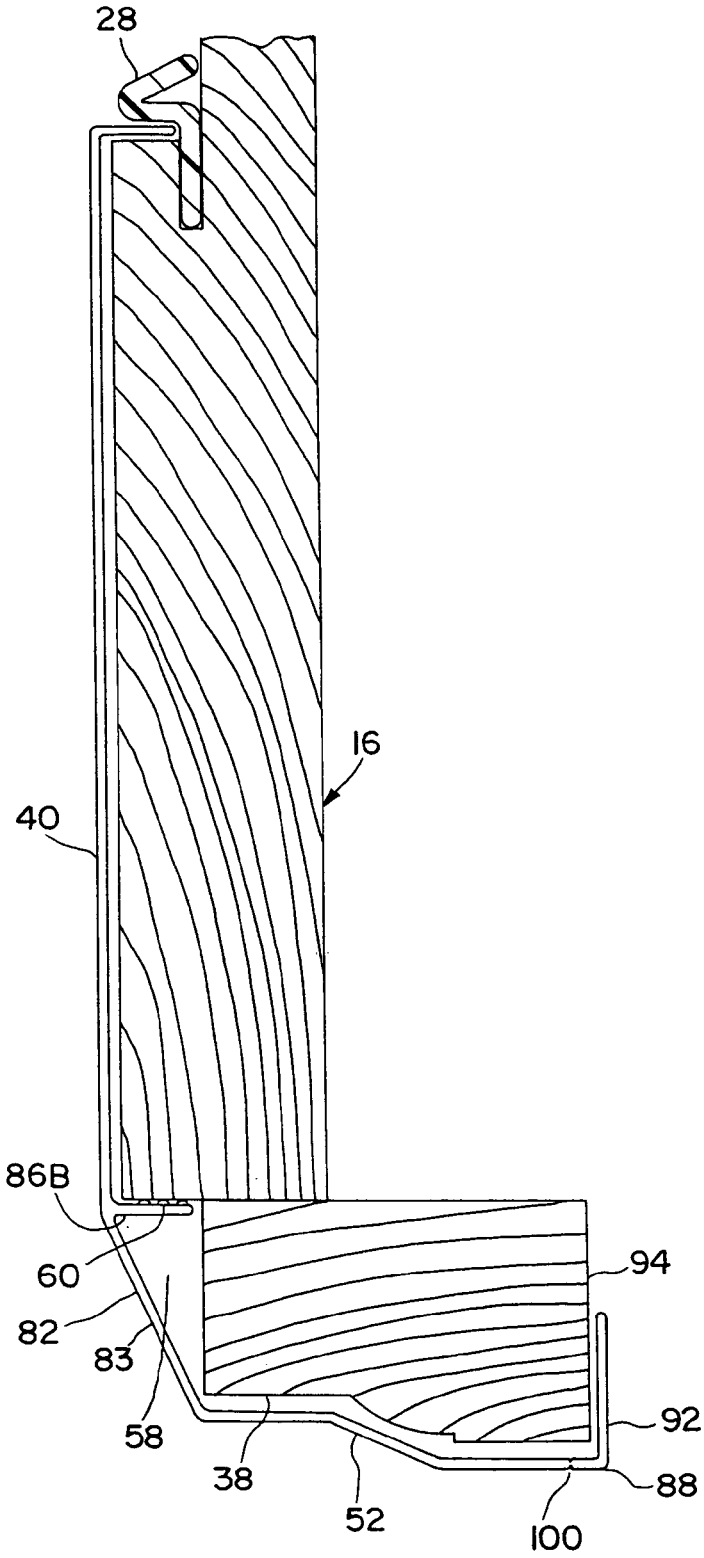
FIG. 10 shows a guard similar to the guard of FIG. 9, mounted on a standard width jamb assembly.

FIGS. 9 and 10 show cross-sections of yet another embodiment of a guard 36 having, as an interface member, a single transfer web 86B, and also having an elongate friction tab 60 extending along the length of the transfer web. The outer portion of central section 40 extends outwardly from transfer web 86B, over cavity 58, and forms an angle with outer leg section 52. In the rest configuration shown in FIG. 9, the outer portion of the central section forms an obtuse angle with the remaining portion of the central section at transfer web 86B, and forms a second obtuse angle with the outer leg section at the intersection with the outer leg section.

The outer leg section generally follows the outline of outer face 38 of the brick mold. As in FIGS. 6 and 7, an outwardly-facing cover tab 92 extends from distal end 88 of outer leg section 52 downwardly over outer face 94 of the brick mold.

Figure 9A:
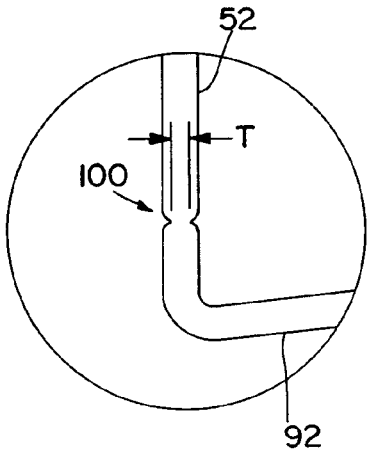
FIGS. 9A, 9B, 9C and 9D are enlarged cross-section representations, taken at circles "A", "B", "C", and "D", respectively, in FIG. 9.

Details of the embodiments of FIGS. 9 and 10 are shown in FIGS. 9A–9D. FIG. 9A shows an optional line of weakness 100 on outer leg section 52 spaced from, but preferably proximate, distal end 88 of the leg section. Locating the line of weakness away from distal edge 88 ensures that, once the tear-off cover tab 92 is removed, along with the small portion of outer leg section 52, the guard allows free access for installation of siding and the like. Contrary to flex joint 102, in FIG. 7, line of weakness 100 is readily torn at the instance of the user, thus to remove the tear-off cover tab 92.

As an illustration of an operable line of weakness 100, thickness of the guard at the line of weakness is about half the thickness of the guard away from, but proximate, the line of weakness. In general, a line of weakness thickness "T" of about 0.015 inch to about 0.030 inch is preferred, with a highly preferred line of weakness thickness being about 0.020 inch with preferred materials. Effective thickness ranges of the line of weakness depend on materials selections, and structure of the line of weakness, whereby thicknesses outside the recited ranges are contemplated where the material selection, and/or structure of the line of weakness, so dictate or suggest.

Figure 9B:
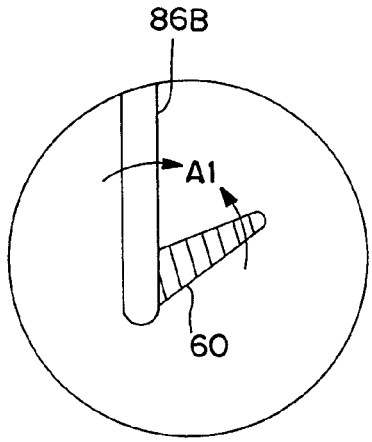

FIG. 9B shows the tapering, cushioning and friction tab 60, elongate in cross-section and angled toward the inner face of central section 40 of the guard at an angle "A1" of about 60 degrees to about 75 degrees, preferably about 65 degrees to about 70 degrees.

Figure 9C:
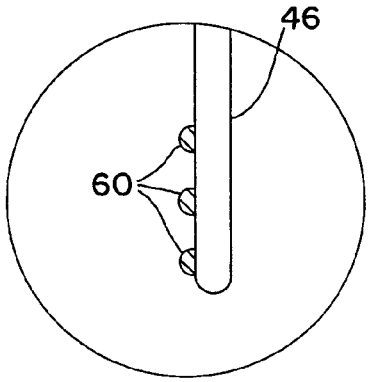

FIG. 9C shows a plurality of friction tabs 60, semicircular in cross-section, located on door leg section 46.

Figure 9D:
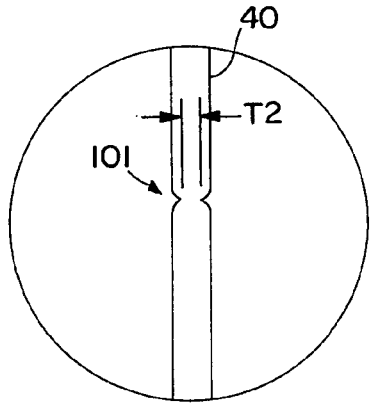

FIG. 9D shows an optional line of weakness at central section 40 of the guard. Line of weakness 101 is located between door leg section 46, and transfer web 86B, and extends the full length of the guard.

If no transfer web is used, the location of line of weakness 101 can be selected still further toward outer leg section 52. As with line of weakness 100, the thickness of the guard at line of weakness 101 is about half the thickness of the guard at locations away from, but proximate, the line of weakness. In general, a line of weakness thickness "T2" of about 0.015 inch to about 0.030 inch is preferred, with a highly preferred line of weakness thickness being about 0.020 inch. As with line of weakness 100, effective thickness ranges of line of weakness 101 depend on materials selection, as well as structure of the line of weakness, whereby thicknesses outside the recited ranges are contemplated where the material selection so dictates.

Either of lines of weakness 100 and 101 can be continuous or discontinuous. While a groove structure is shown, a wide range of structures are known for use as lines of weakness, and all such known structures are contemplated herein to the extent such structures operate in the manner discussed herein.

Comparison of FIGS. 9 and 10 illustrates the resilient bending of guard 36 which takes place as the guard is installed on a jamb assembly 10. Prior to installation of the guard on a door jamb assembly, each of angles "A2", "A3", "A4", and "A5" is preferably in the range of 80 degrees to no more than 88 degrees, preferably no more than 86 degrees. Angle "A1" is the rest, e.g. unstressed, angle in general between tab 60 and transfer surface of transition section 82 defines a relatively sharper corner of the web 86B, and is shown in FIG. 9B. Angle "A2" is the rest angle between the door leg section and the central section. A3 is the rest angle between the central section and transfer web 86B, shown in FIG. 9. A4 is the rest angle described in the central section 40 at transfer web 86B, as illustrated in FIG. 9. A5 is the rest angle between the outer leg section and cover tab 92 as illustrated in FIG. 9.

In installing a properly sized guard on a door jamb and brick mold or other trim, the angles are necessarily enlarged, especially angles "A2" and "A3", to accommodate the perpendicularity of the surfaces of the jamb and brick mold with respect to each other. Especially angles "A2" and "A3" are about 80 degrees to about 86 degrees in order that the installed guard firmly grips the jamb and brick mold, with friction fit.

Thus, the guard is resiliently stressed by the expansion of angle "A3" as the transfer web is stressed, and by the expansion of angle "A2" between the central section and the door leg section, and where used, by the expansion of angle "A5" between the outer leg section and the cover tab. Thus, a potential energy gripping force is imparted to the guard in the process of installing the guard on a jamb assembly.

Figure 11:
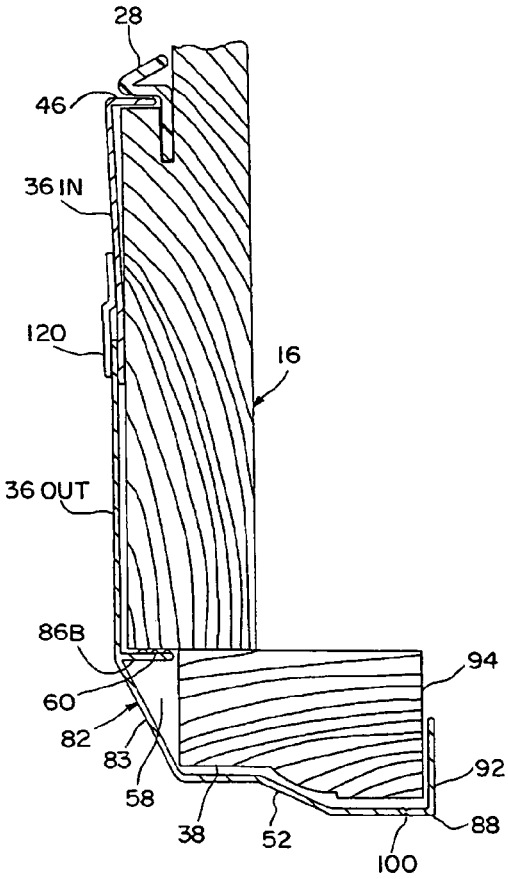
FIG. 11 shows the guard embodiment of FIG. 9, with the line of weakness at the central section broken, and with the thus-separated pieces of the guard covering a jamb assembly having e.g. a non-standard width.

Use of line of weakness 101 is illustrated in FIG. 11. Guards of the invention are sized to fit jamb assemblies which span standard-thickness walls. Thus, standard dimensions between door leg section 46 and transfer web 86B are typically 4 9/16 inches (11.6 cm), such as for a 2×4 frame wall, and 6 9/16 inches (16.7 cm), such as for a 2×6 frame wall. While the span of the central section can be made any dimension desired, for cost effectiveness, the guards of the invention are expected to be produced in a limited number of sizes of central sections.

When a non-standard jamb assembly is to be protected, a standard-size guard is selected, namely the first standard size which, at the central section, is larger than the central section of the jamb assembly which is to be protected. Prior to installing the guard, the guard is broken/torn at line of weakness 101 so as to separate the outer piece 360UT from the inner piece 36IN. The pieces 360UT and 36IN are then mounted over the jamb assembly, with the broken/torn edges overlapping each other as illustrated in FIG. 11. Namely, one of the outer and inner broken pieces 36IN, 360UT is between the other of the broken sections 36IN, 360UT and the inner facing surface 22 of the jamb 16. The amount of overlap depends on the degree to which the inner facing surface of the jamb is smaller in dimension than the central section of the guard.

With the guard thus mounted on the jamb as shown in FIG. 11, with the areas of the central section, adjacent broken line of weakness 101, in underlying and overlying relationship with each other; with the door leg section firmly against the door-arresting surface; with transfer web 86B firmly against outer surface 26 of the jamb, or with the outer leg section 52 firmly against a brick mold, the 2-piece guard is in position to protect the jamb assembly. The guard is then held and maintained in such protecting position by installing pieces of tape 120 over the broken and overlapping line of weakness as illustrated in FIG. 11.

Tape 120 can be continuous along the full length of the broken line of weakness. In the alternative, pieces of tape can be installed at spaced intervals along the length of the broken line of weakness. For example, on a guard 36 protecting a left or right upstanding jamb assembly, in a typical personnel door, four strips of tape might be used, each strip being e.g. 4 inches (10.2 cm) long. A lesser or greater number of pieces of tape can be used. And the pieces can be longer or shorter than the exemplary 4 inches (10.2 cm). Indeed, any amount of tape can be used so long as the tape is at least effective to sufficiently affix the inner and outer guard pieces to each other.

Tape 120 can be any tape which has suitable adhesion to the material used at central section 40 of the guard, and which has suitable strength of tape substrate, to withstand, tolerate, the forces typically expected to be imposed on guard 36. In addition, tape 120 should have limited extensibility whereby the tape controls movement between the respective inner and outer guard pieces in response to forces which tend to expand the width of the tape across the joint between the overlapping inner and outer pieces of the guard.

While the tape can be any desired width, a typical width is about 2 inches. Examples of commonly available tape 120 are commonly known as duct tape, and certain packaging tapes which meet the strength, and limited extensibility, requirements.

FIG. 9 further illustrates a tape 120T mounted to the inner face of the central section. Tape 120T is mounted to central section 40 e.g. when guard 36 is manufactured. A release sheet (not shown) is applied over the surface of the tape which faces away from the central section. When the guard is broken at line of weakness 101, the release tape is removed, and the inner and outer pieces are overlapped with the tape 120T between the inner and outer pieces, thus affixing the inner and outer pieces to each other.

The location of line of weakness 101 can be anywhere between door leg section 46 and outer leg section 52, so long as the location of the separation accommodates the separated edges lying in overlying, underlying relationship with each other without interfering with the guard effectively gripping the jamb assembly.

As referred to herein, the "outer leg section" is that portion of the guard which overlies the outer face 38 of the brick mold.

As referred to herein, the "central section" is that portion of the guard which overlies the inner facing surface 22 of the jamb.

As referred to herein, the "transition section" is that portion of the guard defined between the central section and the outer leg section, and which generally bridges across the open space between corners 54 and 55 of the jamb assembly.

As an overview of the embodiments illustrated, it is seen that each guard has at least some form of contact structure, and preferably a transition section having force-transferring support structure, proximate the most vulnerable areas of the jamb assembly, namely proximate outer corners 54 and 55. In FIGS. 1, 2 and 4, the contact structure is a relatively smaller-radius arcuate corner. In FIG. 5, transition section structure includes relatively larger radius nosing 78, supported by interface member 76. In FIGS. 6, 7 and 8A, the outer surface of transition section 82 is flat, planar, and underlain by transfer webs 86A, 86B which serve as interface members between the nosing section and the underlying jamb and/or trim elements. In FIGS. 8B, 8C, 8D, 8F, and 8J, the outer surface of transition section 82 defines an arc having a relatively larger radius, with underlying support structures. In FIGS. 8E, 8G, 8H, and 8I, the outer surface of transition section 82 defines a relatively sharper corner of the guard, such as a 90 degree angle, and web 83 is underlain by support structure. In FIGS. 8E, 8G, and 8H, underlying support structure includes support material between outwardly-disposed web 83 and the underlying transfer webs.

As a general statement, transition section 82 is an overlying contact structure which directly interfaces with objects which impact on the transition element at or adjacent the corners 54, 55 of the jamb and the trim element. The transition section typically includes underlying support structure adapted and configured to interface with one or more underlying surfaces of the jamb and/or trim element. The transition element is thus the portion of the guard which receives the greatest fraction of the impacts on the guard, and is accordingly designed as a shock absorber, to absorb and distribute the impacts/forces imposed thereon, e.g. from objects passing through the doorway, so as to prevent, or at least substantially attenuate, damage to the jamb assembly.

In view of the wide variety of exemplary transition sections illustrated, it is clear that other equivalent transition sections can be developed, which will function generally in the manner described herein to transfer e.g. impact forces away from outer corners 54 and 55, and to dissipate such forces so as to substantially reduce the amount of damage typically experienced at doorways during a given type of use of the respective doorway.

The material selected for making guard 36, including contact web 83, should be sufficiently durable to withstand expected levels of impact, while having sufficient cushioning effect to protect the jamb assembly from incidental collisions of the nature typically encountered in doorways at a construction site. As typical materials, there can be mentioned a number of plastic compositions such as, for example and without limitation, various of the polyolefins such as and without limitation, high density polyethylene, polypropylene, polyvinyl chloride, polyamide, polyester, and the like. In addition, guard 36 can be made from an expanded foam material such as, for example and without limitation, foamed polyethylene, foamed polypropylene, or foamed polystyrene. Where desired, guard 36 can comprise multiple layers extending over some or all of the length and width of the guard. In such polymeric compositions, typical additives such as slip, release, and like materials can be employed as desired by those skilled in the art.

While a number of polymeric materials have been recited above as materials suitable for making the guard, any of a wide variety of materials, susceptible to fabrication in thin cross-section, can be employed. As other materials, there can be mentioned, for example and without limitation, various metals, heavy paperboard, multiple layer paper and paperboard including products incorporating corrugated media therein, pulp-molded sections, and the like.

Friction tabs 60 can be continuous or discontinuous along the length of the guard. A friction tab 60 can be configured as a strip of material extending along the length of the respective section of the guard. Tabs 60 can be applied by a variety of methods. For example, tabs 60 can be adhesively mounted, e.g. by contact adhesive, such as a double-sided tape, to the guard. Tabs 60 are preferably melt-applied to the guard such as, for example and without limitation, using hot melt adhesives, coextrusion, or extrusion coating processes.

The combination of materials selection, cross-section configuration, and length and width of guard 36, preferably enable resilient flexing of guard 36 toward and away from jamb assembly 10. For example, transfer web 86B and door leg section 46 can be flexed away from the jamb to facilitate mounting the guard to the jamb assembly. As the flexing force is withdrawn, the guard comes into gripping engagement with the jamb assembly as the resilient forces in the guard structure restore the guard toward the rest configuration. Preferably, the inner surface of the guard comes into gripping contact with the outer surface of the jamb assembly before the guard is fully restored to its rest configuration, whereby the resilient forces in the guard assist in retaining the guard securely mounted to the jamb assembly.

Now referring to all the illustrated embodiments, in those preferred embodiments of the invention where guard 36 does not extend substantially inwardly beyond door-arresting surface 24, the guard plays no role in determining the clearance between the door slab and the jamb assembly as the door swings toward door-arresting surface 24. Thus, in such embodiments, the thickness of the guard is not limited by any definition of the swing clearance between the door slab and the jamb assembly. Accordingly, and in such embodiments, guard 36 can be as thick as desired in order to provide the desired level of protective cushioning to the underlying jamb assembly, without considering clearance between the door slab and the jamb assembly. Thus, thickness of the guard can be as little as e.g. about 0.03 inch, and up to any thickness desired, for example up to about 0.25 inch. However, for purposes of economy, and for cost effective performance, while effectively protecting the jamb and brick mold, thickness is typically of the order of about 0.035 inch to about 0.06 inch.

In some embodiments, not shown, guard 36 can include an inwardly-disposed element which extends from door-arresting surface 24 inwardly along inner-facing surface 22 of jamb 16 to an inner surface 118 of the jamb. For an exterior door, the inwardly-disposed element is separate and distinct from the guard 36 as shown, in order to not overlie weather strip 28. For interior doors, where no weather strip is used, the inwardly-disposed element can be an integral part of guard 36. In either event, the inwardly-disposed element does co-occupy jamb space in close proximity with the door slab when the door is closed against the door-arresting surface. Accordingly, the inwardly-disposed element is necessarily thin, e.g. no more than about 0.020 inch thick, in order to facilitate acceptable clearance between the door slab and such inwardly-disposed element.

In the alternative, such inwardly-disposed element can extend less than the full distance to door-arresting surface 46, and can be spaced from the door arresting surface by a distance sufficient to preclude any interference between the guard element and the distal edge of the door slab as the door slab is opened and closed on the doorway opening. Since the uncovered space is located near the door-arresting surface; since the edges of surface 118 are protected, the risk of damage to the jamb is small while the thickness of the inwardly-disposed element can be selected while focusing on protection properties without substantial concern for clearance from the edge of the swinging door slab.

Overall, the guard 36 is resiliently flexible, with rest angles, in some embodiments, between the central section and the outer leg section, and between the central section and the door leg section, of moderately less than 90 degrees, as known in the art, e.g. about 80 degrees to about 88 degrees, so as to exert a degree of resilient restorative force on the jamb assembly, thereby to assist in gripping the jamb assembly when the guard is so installed. Where cover tab 92 is used, the cover tab further, or in the alternative, assists in such gripping.

Guard 36 can be made as a continuous, single-piece plastic extrusion, cut to length, and having a profile as illustrated in e.g. the respective cross-section figures, optionally having lines of weakness 100 and/or 101. In the alternative, the guard can be made as multiple extrusions which are joined together when being installed on the door jamb assembly as illustrated in FIG. 5, or which are joined together in abutting relationship by e.g. edge welding or other known methods of joining edges of especially polymeric profiles, or which are mounted in overlapping relationship as in FIG. 11. Finally, multiple guard elements can be spaced from each other when installed, such as where the inwardly-disposed guard element is spaced from the main body of the guard inwardly in the building of door-arresting surface 46.

The method of fabricating guard 36 will be readily selected by those skilled in the art, from known fabrication methods, once the material, from which the guard is to be made, has been selected. Plastic extrusion is a highly preferred method of fabricating guards 36.

As used herein, the phrase "jamb assembly" collectively refers to, in a first event, a door jamb with which a door slab interfaces, and in a second event also refers to the outer trim element illustrated as brick mold 18, which may be joined to the jamb at the outer surface of the doorway.

Guard 36 is used as follows. Once the jamb assembly has been installed on the building in the rough opening, and either before or after the door slab has been installed in the opening defined by the jamb assembly, guard elements are brought into facing relationship with respective upright and/or top elements of the jamb assembly. Thus, a left guard element having a length approximating the height of the left jamb assembly element is brought into facing relationship with the left jamb assembly element.

The left guard element is urged over the left jamb assembly element, with resilient deflecting of the guard element as the guard element is urged into place, with the door leg section at the door-arresting surface, preferably under any weather stripping; and with the outer leg section overlying at least a portion, preferably all, of outer face 38 of the trim element. Friction tabs 60, in combination with the restorative force inherent in the material of the guard element, the angular deflection from the near perpendicular angles of the leg sections, and friction between the guard and the jamb assembly, all work together to assist in retaining the guard on the jamb assembly.

The right and top guard elements are similarly installed, as desired, such that a major portion, preferably substantially the entirety, of the exposed surface of the jamb assembly, disposed outwardly, in a direction away from the building, of the door-arresting surface, is covered by the guard, as illustrated in the respective cross-sections in the drawings. In those embodiments which employ inwardly disposed elements of guard 36, the guard can also cover the portions of the jamb assembly which are disposed inwardly of the door-arresting surface.

In the preferred embodiments, wherein the guard does not extend inwardly into the building or room or suite, from the door-arresting surface, or where an inwardly-disposed element of the guard is spaced from the door arresting surface, the guard does not interfere with swing of door slab 30 as the door slab is being closed toward door-arresting surface 24, whereby the door slab can be closed on the opening defined in the doorway while the guard is installed about the door jamb assembly, without the guard interfering with swing of the door slab. Accordingly, the door slab can be closed, and optionally locked, thus to deny or otherwise control access to the construction project area in the building while the guard is installed on the jamb assembly.

Thus, the guard can be installed on the jamb assembly as soon as the jamb assembly is constructed, including before the jamb assembly is installed in the door opening, and can remain continuously installed on the jamb assembly while the jamb assembly is being shipped in commerce, while the jamb assembly is being installed in a doorway opening, and throughout the term of the construction or other elevated-risk project, including periods when the door slab is closed and locked, without in any way affecting closing of the door. Accordingly, once guards of the invention are installed on a jamb assembly, such guards can be left installed until such time as the project is substantially completed and danger of damage to the jamb assembly has substantially passed. Such installation of the guard can be done at the jamb assembly manufacturing site, prior to shipping in commerce, whereby the jamb assembly guard serves as a shipping protector, as well as serving as a guard when the jamb assembly is mounted in the doorway of a building.

Flex joint 102, illustrated in FIG. 7, can be employed in a wide range of implementations of guards of the invention. Joint 102 can be used in any of the illustrated embodiments which have a material cross-section, at outer leg section 52, which is susceptible to fabrication of such joint. Typical requirement is that the outer leg section employ a single layer sheet material at the locus of the joint. More complex joint structures can, of course, be fabricated where more complex outer leg sections are employed at the joint locus.

For guards which employ a flex joint 102 as illustrated in FIG. 7, the frame can be shipped to the construction site with the guard already installed. Before, or after, the frame is inserted into the doorway rough opening, the outer leg section is rotated about flex joint 102 to expose outer leg face 94 of the brick mold. Fasteners, not shown, can then be driven through the brick mold for securing the brick mold to the building structure.

Apertures, not shown, can be spaced along the length of the central section 40 extending the thickness of the guard. Such apertures are of sufficient size and configuration to serve as access loci to facilitate driving fasteners, e.g. nails or screws, through jamb 16 and into studs 14, thus to secure jamb 16 to the building. In such implementation, the fasteners do not interact with guard 36 in such manner as to impede subsequent removal of the guard from the jamb assembly e.g. when the construction project has been completed.

Once the period of elevated risk of damage to the jamb assembly has passed, or has been substantially alleviated, the guards can be removed, again with resilient deflection of the guards, and/or with deflection of outer leg section 52 and/or cover tab 92, whereupon the jamb assembly, as covered by the guards, should be free of collision-imposed defects. At minimum, the incidence, and level of severity, of affect on the jamb assembly, is substantially reduced as a result of having used guard 36 to protect the jamb assembly. The temporary door slab is typically, at the same time, replaced with the permanent door slab, whereupon the doorway can be released to custody of the owner or occupant of the building in good condition, in spite of typical construction-related impacts, associated with the e.g. construction project, which may have been imposed on the doorway during the pendency of the construction project.

As used herein, the phrase "inner-facing surface" of the jamb assembly refers primarily to the inner facing surface 22 of the jamb, but also and as appropriate, refers to surface 96 of the brick mold. Thus, to the extent the inner facing surface of the trim element is displaced from the inner facing surface of the jamb, as in the illustrated embodiments, the inner facing surface of the jamb assembly can be discontinuous with respect to a step change at the trim element.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A doorjamb assembly guard, adapted and configured to be installed over a doorjamb assembly, such doorjamb assembly comprising a doorjamb, and an outer trim element joined with such door jamb, such outer trim element and such door jamb defining an interior corner, such door jamb having an inner-facing surface defining a doorway opening, a door-arresting surface, and an outer surface facing away from such door-arresting surface, such inner-facing surface extending from such door-arresting surface to such outer surface, said doorjamb assembly guard comprising:

(a) a central section which overlies the inner-facing surface of such doorjamb assembly, said central section having a first door side, and a second opposing side displaced from the door side;

(b) a door leg section, connected to said central section at said first door side; and (c) a third section, directly or indirectly connected to said central section at said second side and facing away from such doorway opening, said door jamb assembly guard defining a shock absorber, an element of said shock absorber being adapted and configured to extend between such trim element and such door jamb and to be spaced from such interior corner, said third section comprising, in at least partial definition of said shock absorber, an interface member connected to said central section at said second side facing away from such door, said interface member being sized and configured to extend at a transverse angle to said central section, said interface member being arranged and configured such that said interface member can extend over, and overlie, at least a portion of such outer surface of such door jamb assembly, said third section further comprising a resiliently cushioning nose member extending outwardly in front of said interface member, a cavity optionally being defined between said interface member and said resiliently cushioning nose member.

2. A doorjamb assembly guard, said doorjamb assembly guard being adapted and configured to be installed over a doorjamb assembly, such door jamb assembly comprising a doorjamb, and an outer trim element joined with such door jamb, such outer trim element and such door jamb defining an interior corner, such door jamb having an inner-facing surface defining a doorway opening, a door-arresting surface, and an outer surface facing away from such door-arresting surface, such inner-facing surface extending from such door-arresting surface to such outer surface, said doorjamb assembly guard comprising:

(a) a central section which overlies the inner-facing surface of such door jamb assembly, said central section having a first door side, and a second opposing side displaced from the door side;

b) a door leg section, connected to said central section at said first door side; and (c) a third section, directly or indirectly connected to said central section at said second and side facing away from such doorway opening, said temporary door jamb assembly guard defining a shock absorber, an element of said shock absorber being adapted and configured to extend between such trim element and such door jamb and to be spaced from such interior corner, further comprising a cover tab (92), extending from a distal end (88) of said third section, and adapted to extend over an outer face (94) of a trim element of such jamb assembly, with a line of weakness (102) in the third section.

3. A door jamb assembly guard as in claim 2 the line of weakness in said third section being located at a locus overlying an outer surface (38) of a such trim element.

4. A door jamb assembly guard as in claim 2, the line of weakness being adjacent, but displaced from, distal end (88) of said third section.

5. A door jamb assembly guard as in claim 2, the lie of weakness being at the distal end (88) of the third section.

6. A doorjamb assembly guard, said doorjamb assembly guard being adapted and configured to be installed over a doorjamb assembly, such door jamb assembly comprising a door jamb, and an outer trim element joined with such door jamb, such outer trim element and such doorjamb defining an interior corner, such door jamb having an inner-facing surface defining a doorway opening, a door-arresting surface, and an outer surface facing away from such door-arresting surface, such inner-facing surface extending from such door-arresting surface to such outer surface, said doorjamb assembly guard comprising:

(a) a central section which overlies the inner-facing surface of such door jamb assembly, said central section having a first door side, and a second opposing side displaced from the door side;

(b) a door leg section, connected to said central section at said first door side; and (c) a third section, directly or indirectly connected to said central section at said second side facing away from such doorway opening, said door jamb assembly guard defining a shock absorber, an element of said shock absorber being adapted and configured to extend between such trim element and such doorjamb and to be spaced from such interior corner said third section being designed and configured to fit, on a correspondingly configured door jamb assembly, between such door-arresting surface and a weather strip element mounted proximate such door arresting surface.

7. A doorjamb assembly guard, said doorjamb assembly guard being adapted and configured to be installed over a doorjamb assembly, such door jamb assembly comprising a doorjamb, and an outer trim element joined with such door jamb, such outer trim element and such door jamb defining an interior corner, such door jamb having an inner-facing surface defining a doorway opening, a door-arresting surface, and an outer surface facing away from such door-arresting surface, such inner-facing surface extending from such door-arresting surface to such outer surface, said doorjamb assembly guard comprising:

(a) a central section which overlies the inner-facing surface of such door jamb assembly, said central section having a first door side, and a second opposing side displaced from the door side;

(b) a door leg section, connected to said central section at said first door side; and (c) a third section, directly or indirectly connected to said central section at said second side facing away from such doorway opening, said door jamb assembly guard defining a shock absorber, an element of said shock absorber being adapted and configured to extend between such trim element and such door jamb and to be spaced from such interior corner, and wherein said central section further comprises a release ridge (114) extending along a length thereof, which release ridge is displaced from an underlying jamb by a distance (D1) greater than a base distance (D2) by which a remainder of said central section is displaced from such jamb.

8. A doorjamb assembly guard, said doorjamb assembly guard being adapted and configured to be installed over a doorjamb assembly, such door jamb assembly comprising a door jamb, and an outer trim element joined with such door jamb, such outer trim element and such door jamb defining an interior corner, such door jamb having an inner-facing surface defining a doorway opening, a door-arresting surface, and an outer surface facing away from such door-arresting surface, such inner-facing surface extending from such door-arresting surface to such outer surface, said doorjamb assembly guard comprising:

(a) a central section which overlies the inner-facing surface of such door jamb assembly, said central section having a first door side, and a second opposing side displaced from the door side;

(b) a door leg section, connected to said central section at said first door side; and (c) a third section, directly or indirectly connected to said central section at said second side facing away from such doorway opening, said door jamb assembly guard defining a shock absorber, an element of said shock absorber being adapted and configured to extend between such trim element and such door jamb and to be spaced from such interior corner, said central section comprising a line of weakness (101) extending along a length of said central section, wherein the line of weakness defines inner and outer separable pieces, and facilitates separating said guard into inner (36IN) and outer (360UT) separate pieces.

9. A door jamb assembly guard as in claim 8, further comprising affixing a structure on at least one of the inner and outer separable pieces prior to separation at the line of weakness, adapted to affix the inner and outer separate pieces to each other in overlapping relationship.

10. A doorjamb assembly guard having a length, and being adapted and configured to be installed over a door jamb assembly, such door jamb assembly comprising a doorjamb, and an outer trim element joined with such doorjamb, such doorjamb having an inner-facing surface defining a doorway opening, a door-arresting surface, and an outer surface facing away from such door-arresting surface, such inner-facing surface extending from such door-arresting surface to such outer surface, such outer trim element and such door jamb defining an interior corner where such outer surface of such doorjamb meets a doorway-facing surface of such outer trim element, said door jamb assembly guard comprising:

(a) a central section which overlies the inner-facing surface of such door jamb assembly, said central section having a first door side, and a second opposing side displaced from such door side;

(b) a door leg section, connected to said central section at said first door side and sized and configured to extend at a transverse angle to said central section along such door-arresting surface of such doorjamb assembly; and (c) a third section, directly or indirectly connected to said central section at said second side facing away from such doorway opening, said third section being sized and configured to extend at a transverse angle to said central section, the second side of said central section of said door frame guard being arranged and configured such that the third section, connected thereto, can be disposed against a such surface of such doorjamb assembly, and can extend over, and overlie, at least a portion of such surface of such door jamb assembly, said door jamb assembly guard defining a shock absorber, an element of said shock absorber being adapted and configured to protect at least one of such trim element and such doorjamb and to be spaced from such interior corner, said guard defining a terminal edge thereof which does not extend substantially beyond the door leg section.

11. A doorjamb assembly guard as in claim 10 wherein said guard can be installed on a door jamb assembly, and wherein a respective conventional door mounted to such door jamb assembly can be closed with said guard so installed, without interfering with operation of such door.

12. A doorjamb assembly guard as in claim 10 wherein said guard is designed and configured to fit over and protect such outer trim element as part of such doorjamb assembly.

13. A doorjamb assembly guard as in claim 10, said door leg section having a first length between said first door-facing side of said central section and an opposing distal edge of said door leg section, said third section having a second length, substantially greater than the first length, between said second side of said central section and an opposing distal edge of said third section.

14. A doorjamb assembly guard as in claim 10 wherein said door jamb assembly guard covers less than the entirety of a width of the inner-facing surface of a such door jamb assembly for which said guard has been designed and configured.

15. A door jamb assembly guard as in claim 10, said element of said shock absorber comprising a transition section between said central section and said outer leg section, said transition section comprising a contact web (83) overlying at least one transfer web (86A, 86B).

16. A doorjamb assembly guard as in claim 10, said central section comprising a line of weakness extending along a length of said central section, wherein the line of weakness defines inner and outer separable pieces, and facilitates separating said guard into inner (36IN) and outer (360UT) separate pieces.

17. A door jamb assembly guard as in claim 16, further comprising affixing structure on at least one of the inner and outer separable pieces prior to separation at the line of weakness, adapted to affix the inner and outer separate pieces to each other in overlapping relationship.

18. A doorjamb assembly as in claim 10 wherein an element of said shock absorber is adapted and configured to be spaced from, and to extend over, at least a portion of such trim element and a portion of such doorjamb.

19. A doorjamb assembly guard, having a length, and being adapted and configured to be installed over a door jamb assembly, such door jamb assembly comprising a doorjamb, an outer trim element joined with such doorjamb, such outer trim element and such doorjamb defining an interior corner, such doorjamb having an inner-facing surface defining a doorway opening, a door-arresting surface, and an outer surface facing away from such door-arresting surface, such inner-facing surface extending from such door-arresting surface to such outer surface, said door jamb assembly guard comprising:

(a) a central section which overlies the inner-facing surface of such door jamb assembly, said central section having a first door side, and a second opposing side displaced from such door side;

(b) a door leg section, connected to said central section at said first door side and sized and configured to extend at a transverse angle to said central section along such door-arresting surface of said doorjamb assembly; and (c) a third section, directly or indirectly connected to said central section at said second side facing away from such doorway opening, said third section being sized and configured to extend at a transverse angle to said central section, the second side of said central section of said door frame guard being arranged and configured such that the third section, connected thereto, can be disposed against a such surface of such door jamb assembly, such that said third section can extend over, and overlie, at least a portion of such surface of such door jamb assembly, said door jamb assembly guard defining a shock absorber, an element of said shock absorber being adapted and configured to protect at least one of such trim element and such door jamb and to be spaced from such interior corner, said guard defining a terminal edge thereof which does not extend substantially beyond the door leg section, said third section comprising, in at least partial definition of said shock absorber, an interface member, sized and configured to extend at a transverse angle to said central section, said interface member being arranged and configured such that said interface member can extend over, and overlie, at least a portion of such outer surface of such door jamb assembly, said third section further comprising a resiliently cushioning nose member extending outwardly in front of said interface member, a cavity optionally being defined between said interface member and said resiliently cushioning nose member.

20. A doorjamb assembly guard for installation over, and for temporarily protecting, a doorjamb assembly, such doorjamb assembly having an inner-facing surface defining a door opening, a door-arresting surface, and an outer surface facing away from such door-arresting surface, such inner-facing surface extending from such door-arresting surface to such outer surface, said door jamb assembly guard comprising:

(a) a central section which can overlie the inner-facing surface of such door jamb assembly, said central section having a first door side, and a second opposing trim side displaced from the door side;

(b) a door leg section, connected to said central section at said first door side and extending at a transverse angle to said central section so as to extend along such door-arresting surface of said door jamb assembly;

(c) a third section, disposed outwardly of said central section at said second side facing away from such door opening, and disposed away from such wall, said third section extending at a transverse angle to said central section so as to extend over, and overlie, at least a portion of such outer surface of such doorjamb assembly; and (d) a transition section between said central section and said third section, said transition section comprising an overlying contact structure directly interfacing with objects which impact on said transition element, and underlying support structure adapted and configured to interface with one or more underlying surfaces of such jamb assembly, said transition section being effective to absorb and distribute forces imposed thereon so as to attenuate damage to such jamb assembly.

21. A doorjamb assembly guard as in claim 20 wherein said guard can be installed on a doorjamb assembly, and wherein a respective conventional door mounted to such door jamb assembly can be closed with said guard so installed, without interfering with operation of such door.

22. A doorjamb assembly guard as in claim 20 wherein said guard is designed and configured to fit over and protect an outer trim element as part of such doorjamb assembly.

23. A doorjamb assembly guard as in claim 20 wherein said door jamb assembly guard covers less than the entirety of a width of the inner-facing surface of a such door jamb assembly for which said guard has been designed and configured.

24. A doorjamb assembly guard as in claim 20 wherein said door leg section terminates at a distal edge thereof comprising a distal edge of said guard, and consistent with termination in the vicinity of, and protecting, such door arresting surface.

25. A door jamb assembly guard as in claim 20, further comprising a cover tab, extending from a distal end (88) of said third section, and adapted to extend over an outer face (94) of a trim element of such jamb assembly, with a line of weakness at the distal end (88) of the outer leg section.

26. A door jamb assembly guard as in claim 20, further comprising a cover tab extending from a distal end of said third section, and adapted to extend over an outer face (94) of a trim element of such jamb assembly, and a line of weakness at a locus overlying an outer surface (38) of a such trim element adjacent, but displaced from, distal end (88) of said third section.

27. A door jamb assembly guard as in claim 20, further comprising a flex joint in said third section, operative for rotating a distal edge of said third section away from an underlying such doorjamb assembly.

28. A doorjamb assembly guard as in claim 20, said contact structure comprising a contact web (83) extending between first and second sides thereof at said third section and said central section, said underlying support structure comprising at least one transfer web, extending from one of said first and second sides of said contact structure in a direction along at least one of (i) a surface of a trim element or (ii) an outer surface of such jamb.

29. A doorjamb assembly guard as in claim 20 wherein said contact structure comprises a contact web (83), and wherein said underlying support structure comprises a transfer web (86B) extending from said contact web (83) along an outer surface (26) of such doorjamb assembly to a locus proximate an intersection of such outer face (26) and an adjoining surface (87) of a trim element.

30. A door jamb assembly guard as in claim 20, said underlying support structure of said transition section being adapted and configured to reside in a cavity defined between said contact structure, an inner facing surface (87) of such trim element, and an outer surface (26) of such jamb, and to transfer forces from said contact structure to underlying surfaces of such trim element and/or such jamb at locations away from outer corners (54, 55) of such trim element and such jamb.

31. A door jamb assembly guard as in claim 20, said underlying support structure comprising transfer webs connected to said contact structure and to each other to define a cavity between said transfer webs and said contact structure, and further comprising support webs (112) extending between said contact structure and at least one of said transfer webs.

32. A doorjamb assembly guard as in claim 20, said central section comprising a line of weakness extending along a length of said central section, wherein the line of weakness defines separable inner and outer pieces of said guard, and facilitates separating said guard into inner (36 IN) and outer (360UT) separate pieces.

33. A door jamb assembly guard as in claim 32, further comprising affixing structure on at least one of the inner and outer separable pieces prior to separation at the line of weakness, adapted to affix the inner and outer separate pieces to each other in overlapping relationship.

34. A doorjamb assembly as in claim 20, such doorjamb assembly defining first and second outer corners (54, 55) facing generally outwardly of a building into which such door jamb assembly may be installed, and an adjacent interior corner, said overlying contact structure being adapted and configured to extend between such outer corners (54, 55) and across, and spaced from, such interior corner.

35. A doorjamb assembly guard for installation over a door jamb assembly, such door jamb assembly having an inner-facing surface defining a doorway opening, a door-arresting surface, and an outer surface facing away from such door-arresting surface, such inner-facing surface extending from such door-arresting surface to such outer surface, said door jamb assembly guard comprising:

(a) a central section which overlies the inner-facing surface of such door jamb assembly, said central section having a first door side, and a second opposing side facing away from such door side;

(b) a door leg section, connected to said central section at said first door side and sized and configured to extend at a transverse angle to said central section along such door-arresting surface of such door jamb assembly: and (c) a third section directly or indirectly connected to said central section at said second side facing away from such door opening, said third section at least in part defining a resiliently cushioning nose member, said guard defining a terminal edge thereof which does not extend substantially beyond the door leg section, said central section comprising a line of weakness extending along a length of said central section, wherein the line of weakness defines inner and outer separable pieces of said guard, and facilitates separating said guard into inner (36IN) and outer (360UT) separate pieces.

36. A door jamb assembly guard as in claim 35, further comprising the step of placing affixation structure on at least one of the inner and outer separable pieces prior to separation at the line of weakness, the affixation structure being adapted to affix the inner and outer separate pieces to each other in overlapping relationship.

37. In combination, a doorjamb assembly defining a doorway opening, and a guard mounted over and overlying at least a portion of said door jamb assembly, the combination comprising:

(a) said door jamb assembly having a door jamb, and an outer trim element joined with the doorjamb, said doorjamb comprising an inner-facing surface facing into the doorway opening, a door-arresting surface, and an outer surface facing away from the door-arresting surface, the inner-facing surface extending from the door-arresting surface to the outer surface, said outer trim element and such doorjamb defining first and second outer corners (54, 55) and an interior corner between said outer corners; and (b) said guard protecting said doorjamb assembly from incidental damage, and comprising (i) a central section overlying the inner-facing surface of the door jamb assembly, said central section having a first door side, and a second opposing side displaced from the door side, and (ii) a third section, directly or indirectly connected to said central section at said second side, and extending away from the door opening, said third section extending at a transverse angle to said central section, said third section being disposed against, and protecting, the outer surface of the door jamb assembly, said guard defining a shock absorber adjacent the joinder of the door jamb and the trim element, at least a portion of said shock absorber being spaced from said interior corner, said shock absorber protecting at least one of such door jamb and such trim element proximate the respective outer corner (54, 55), so as to transfer forces away from the respective outer corner (54, 55), thereby to reduce damage to said jamb assembly, further comprising weather stripping adjacent the door-arresting surface, said door leg section being disposed between the door-arresting surface and said weather stripping, without interfering with routine mounting, or routine operation, of the weather stripping.

38. A combination as in claim 37 wherein a conventional door, mounted to said doorjamb assembly, can be closed with said guard so installed, without interfering with operation of such door.

39. A combination as in claim 37 wherein said guard overlies and protects a brick mold as part of said door jamb assembly.

40. A combination as in claim 37, said third section comprising an interface member sized and configured to extend at a transverse angle to said central section, the second side of said central section of said door frame guard being arranged and configured such that said interface member can extend over, and overlie, at least a portion of the outer surface of the door jamb assembly, said third section further comprising a resiliently cushioning nose member extending outwardly in front of said interface member, a cavity being optionally defined between said interface member and said resiliently cushioning nose member.

41. A combination as in claim 37 wherein said guard covers less than the entirety of a width of the inner-facing surface of a said doorjamb assembly.

42. A combination as in claim 37, said shock absorber comprising a transition section between said central section and said outer leg section.

43. A combination as in claim 37, said guard comprising inner (36IN) and outer (360UT) separate pieces, overlapping each other at said central section, and secured to each other.

44. A method of protecting a doorjamb assembly which defines a doorway opening, from incidental damage during a construction project which is associated with a building, and which has a beginning and an end, the doorjamb assembly comprising left and right upstanding jamb assembly elements, and optionally an upper jamb assembly element extending between the left and right upstanding jamb assembly elements, each such jamb assembly element having an inner-facing surface facing into the doorway opening, a door-arresting surface, and an outer surface facing away from the door-arresting surface, the inner facing surface extending from the door-arresting surface to the outer surface, the door jamb assembly defining first (54) and second (55) outer corners, and an inwardly directed corner disposed generally between the first and second outer corners, the method comprising:

(a) early in the construction project, mounting a combination of the jamb assembly, a first door slab, and a removable jamb assembly guard in a doorway opening of the building, thus controlling access to the building while protecting the door jamb assembly from incidental damage, the jamb assembly guard comprising (i) a central section which overlies the inner-facing surface of the door jamb assembly, and which has a first door side, and a second opposing side displaced from the door side, (ii) a door leg section, connected to said central section at said first door side, and (iii) a third section, connected directly or indirectly to the central section at the second side displaced from the doorway opening, the third section extending at a transverse angle to the central section, the third section of the guard thus being disposed against the door jamb assembly such that the third section extends over, and overlies, at least a portion of the doorjamb assembly, the outer corners (54, 55) underlying the jamb assembly guard, the jamb assembly guard defining a shock absorber which extends generally between the underlying outer corners (54, 55), and which transfers forces away from the underlying corners (54, 55); and (b) toward or at the end of the construction project, removing the jamb assembly guard from the door jamb assembly and replacing the first door slab with a second door slab.

45. A method as in claim 44, including installing the guard on the jamb assembly in combination with a door slab being installed on the jamb assembly, and including closing the door slab, thus to close the door opening, with the guard so installed and without interference between operation of the door slab and the guard.

46. A method as in claim 44, the central section comprising inner and outer section elements, for interlocking with each other thereby to establish an adjusted width of the central section, the method comprising placing the guard over the jamb assembly with the central section in surface-to-surface contact with the inner-facing surface of the jamb assembly, the outer section element being disposed relatively outwardly of the doorway opening, the inner section element being disposed at the door-arresting surface, the method further comprising urging the inner and outer section elements toward each other, thus slidingly engaging the inner and outer sections with each other and causing the inner and outer sections to grippingly engage the door-arresting surface of the jamb assembly and the outer surface of the jamb assembly, thus to custom adjust the guard to the respective jamb assembly.

47. A method as in claim 44, the method further comprising separating the guard into separate inner and outer pieces, at the central section, installing the inner and outer pieces on one of the jamb assembly elements, with elements of the central section overlapping each other over an inner facing surface of the respective jamb assembly element so as to form respective inner and outer surfaces of an overlap area of the central section, and affixing the overlapped central section elements to each other so as to maintain the overlapped elements in overlapping relationship, and so as to hold the guard on the jamb assembly.

48. A method of protecting a doorjamb assembly which defines a doorway opening, from incidental damage during a construction project which is associated with a building, and which has a beginning and an end, the doorjamb assembly comprising left and right upstanding jamb assembly elements, and optionally an upper jamb assembly element extending between the left and right upstanding jamb assembly elements, each such jamb assembly element having an inner-facing surface facing into the doorway opening, a door-arresting surface, and an outer surface facing away from the door-arresting surface, the inner facing surface extending from the door-arresting surface to the outer surface, the door jamb assembly defining first (54) and second (55) outer corners, and an inwardly directed corner disposed generally between the first and second outer corners, the method comprising:

(a) early in the construction project, mounting a combination of the jamb assembly, a door slab, and a removable jamb assembly guard in a doorway opening of the building, thus controlling access to the building while protecting the door jamb assembly from incidental damage, the jamb assembly guard comprising (i) a central section which overlies the inner-facing surface of the door jamb assembly, and which has a first door side, and a second opposing side displaced from the door side, (ii) a door leg section, connected to said central section at said first door side, and (iii) a third section, connected directly or indirectly to the central section at the second side displaced from the doorway opening, the third section extending at a transverse angle to the central section; and (b) toward or at the end of the construction project, removing the jamb assembly guard from the doorjamb assembly.

* * * * *

UNITED STATES PATENT AND TRADEMARK OFFICE

CERTIFICATE OF CORRECTION

PATENT NO. : 7,204,059 B2
APPLICATION NO. : 10/615960
DATED : April 17, 2007
INVENTOR(S) : Glenn P. Schiffmann and David R. Cox It is certified that error appears in the above-identified patent and that said Letters Patent is hereby corrected as shown below:

The term '36OUT' is shown as '360UT' with 360 as numerals and UT as letters; the term should read '36OUT' with 36 as numerals and OUT as letters. Therefore, please replace "360UT" with --36OUT-- in each of the following locations:

Column 18, lines 29, 30, 33, 34
Column 26, line 27 in claim 8
Column 27, line 34 in claim 16
Column 29, line 62 in claim 32
Column 30, line 35 in claim 35
Column 31, line 44 in claim 43

Signed and Sealed this
Fourteenth Day of June, 2011

David J. Kappos

David J. Kappos
*Director of the United States Patent and Trademark Office*